United States Patent [19]

Koike et al.

[11] Patent Number: 4,551,033

[45] Date of Patent: Nov. 5, 1985

[54] SERIAL ELECTRIC PRINTER USING SINGLE UNIDIRECTIONAL MOTOR

[75] Inventors: Hiroshi Koike; Shuhei Takeuchi, both of Morioka; Mikio Miyajima, Iwate, all of Japan

[73] Assignee: Alps Electric Co., Ltd., Japan

[21] Appl. No.: 487,959

[22] Filed: Apr. 25, 1983

Related U.S. Application Data

[62] Division of Ser. No. 299,551, Sep. 4, 1981, Pat. No. 4,410,189.

[30] Foreign Application Priority Data

Sep. 5, 1980 [JP] Japan ..... 55-123040

[51] Int. Cl.[4] ..... B41J 19/20; B41J 19/62

[52] U.S. Cl. ..... 400/308; 400/313; 400/332.5; 400/307.2; 400/297; 400/293; 400/332.6

[58] Field of Search ..... 400/73, 308, 332.6, 400/312, 328, 307.2, 296.2, 330.8, 293, 297, 298, 305, 332.4, 313, 332.6; 101/93.16–93.18

[56] References Cited

U.S. PATENT DOCUMENTS

| | | | |
|---|---|---|---|
| 915,749 | 3/1909 | Drewell | 400/305 |
| 2,223,529 | 12/1940 | Potter | 400/307.2 |
| 3,532,205 | 10/1970 | Ozaki et al. | 400/328 |
| 3,605,978 | 9/1971 | Kawano | 101/93.18 |
| 3,608,692 | 9/1971 | Henry | 400/328 |
| 3,739,899 | 6/1973 | Brumbaugh et al. | 400/332.6 |
| 3,822,774 | 7/1974 | Bucksey | 400/173 |
| 3,934,698 | 1/1976 | McGourty | 400/332 |
| 3,978,961 | 9/1976 | Thomson | 400/332 |
| 3,985,220 | 10/1976 | Rix et al. | 400/307.2 |
| 4,420,267 | 12/1983 | Iwane | 400/332.6 |

*Primary Examiner*—William Pieprz

*Attorney, Agent, or Firm*—Guy W. Shoup; Gerard F. Dunne

[57] ABSTRACT

A serial printer having a carriage adapted to be shifted transversely of a paper and a type cylinder carried by the carriage in such a manner as to be able to be shifted up and down and to be rotated, so that the printing is effected by pressing the desired type character against the paper. The improvement comprises that the vertical shifting of the type cylinder, rotation of the type cylinder, driving of the hammer, shifting of the carriage and other kinds of operation are performed by the force derived from a single motor, and that operation such as spacing and back spacing of the carriage, paper feeding and so forth is achieved when the type cylinder selects a visible position.

3 Claims, 25 Drawing Figures

SERIAL ELECTRIC PRINTER USING SINGLE UNIDIRECTIONAL MOTOR

This is a division of copending application Ser. No. 299,551, filed Sept. 4, 1981, now U.S. Pat. No. 4,410,189, issued Oct. 18, 1983.

BACKGROUND OF THE INVENTION

The present invention relates to a serial printer and, more particularly, to a serial printer of the type in which a carriage carrying a type cylinder is moved along the line to be printed and, at each position of the carriage, one of the type elements on the periphery of the type cylinder is selectively pressed against a record paper to print the character corresponding to the type element selected.

This type of serial printer is increasingly being used in electric typewriters, output devices of computers and so forth, because of its clean printing, its ability to be used with ordinary printing papers and so forth, thanks to the printing with type elements impacting the paper. Hitherto, various serial printers using so-called daisey type wheels or vertically and rotatively movable type cylinders carrying type elements to impact the record paper have been known.

In the known serial printers using a daisey type wheel, however, the size of the carriage carrying the type wheel is inevitably increased because the carriage is typically required to carry also a motor for driving the type wheel, a hammer, and an electromagnetic device for actuating the hammer. The increased size of the carriage in turn necessitates an increased capacity of the motor for driving the carriage. In addition, various operations such as selection of the type element, shifting of the carriage, actuation of the hammer and the feeding of paper require independent driving sources such as motors or electromagnetic devices. In consequence, the size and weight of the printer as a whole are increased undesirably. Such printers, therefore, are not readily suitable for use as portable serial printers, particularly since such printers typically have three expensive motors as the driving sources for carriage shifting and paper feed and the like which are particularly large-sized and expensive. It is thus difficult to reduce production costs of such printers.

The second type of known serial printer using the vertically and rotatively movable type cylinder suffers the same disadvantages. Namely, independent and different driving power sources are required for various operations such as vertical driving of the type cylinder, rotation of the same, shifting of the carriage, impacting of the type wheel as a whole against the platen, and feeding of the paper, resulting in an increased size and elevated production cost of the printer. The weight is increased also so that this type of serial printer cannot suitably be used in portable electric typewriters.

SUMMARY OF THE INVENTION

Accordingly, an object of the invention is to provide a serial printer suitable for use in portable electric typewriters.

Another object of the invention is to provide a serial printer in which various operations are made by the power derived from a common single motor, so that the number of expensive motors can be reduced economically.

A further object of the invention is to provide a serial printer in which the number of the driving power sources is decreased to reduce the size and weight of the printer and to lower the production cost of the same.

A still further object of the invention is to provide a printer incorporating a light-weight and small-sized carriage which does not carry any driving power source such as motor or solenoid.

A still further object of the invention is to provide a printer in which three different operations: i.e. vertical driving of a type cylinder, rotation of the same and actuation of the hammer or shifting of the carriage are achieved by the power derived from a single unidirectional D.C. motor.

A still further object of the invention is to provide a printer in which the shifting of the carriage or actuation of the hammer, in addition to the above-mentioned three operations, is made by the power derived from the above-mentioned single unidirectional motor.

A still further object of the invention is to provide a printer in which, in addition to the aforementioned various kinds of operation, feeding of the paper is effected by the power derived from the above-mentioned single unidirectional D.C. motor.

A still further object of the invention is to provide a printer in which the shifting of the carriage is achieved by cooperation between a column shift screw member and a rack and, by controlling the state of engagement between the rack and the screw member, the carriage returning operation and the back spacing operation at predetermined pitch are effected by a carriage return spring, thereby to make it possible to effect the carriage returning operation and the back spacing operation without using an expensive pulse motor.

A still further object of the invention is to provide a printer in which operations such as spacing, back spacing, carriage returning and the paper feeding are conducted when a predetermined shift position of the type cylinder, which position being a visible position located at the lowermost stage, is selected, thereby to permit the operator to visually check the printed data immediately after the printing.

DESCRIPTION OF THE PREFERRED EMBODIMENT

Figure 1:
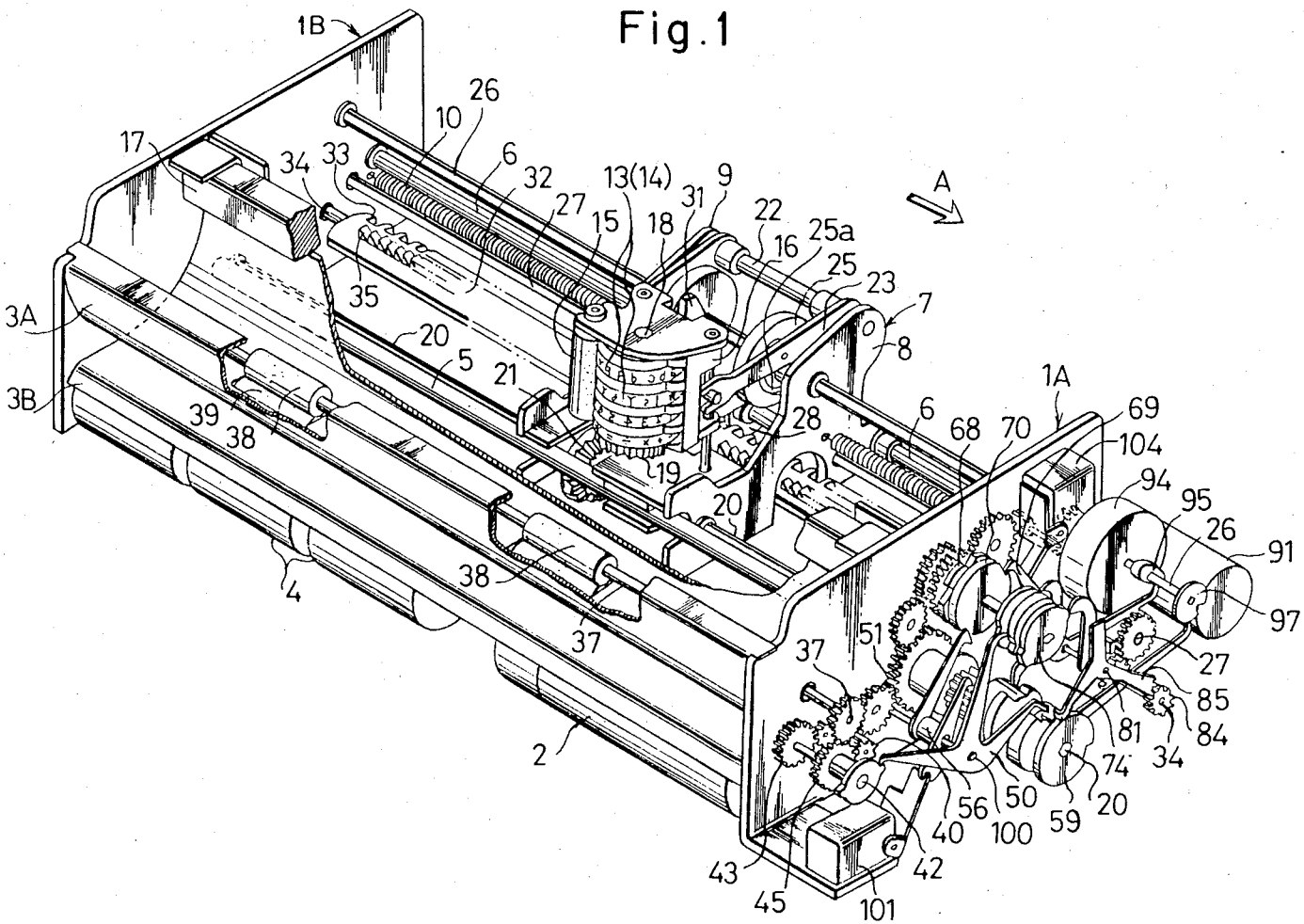
FIG. 1 is a perspective view of a serial printer constructed in accordance with an embodiment of the invention.

Hereinafter, the invention will be fully described through a preferred embodiment.

First of all, the outline of the construction of the serial printer of the invention as a whole will be explained with specific reference to FIG. 1 which is a perspective view of the printer in the assembled state and also to FIG. 3 which is an exploded perspective view of the carriage.

GENERAL CONSTRUCTION

A serial printer of the invention has an outside measurement of 280 mm (length)×130 mm (crosswise width)×60 mm (height). This size is suitable for the serial printer to be incorporated in a portable electric typewriter of about A-4 size having a height of between 70 and 80 mm.

Since the printer is used in a portable typewriter, dry cell batteries are used as the driving power supply in the embodiment described hereinunder, although the printer may be constructed to operate with electric power supplied by a chargeable nickel-cadmium battery or the like, or even from commercial electric power.

The serial printer has a framework including side frames 1A,1b between which are extended in parallel a multiplicity of rotary shafts and guide shafts. The rotation of these rotary shafts is controlled by gear trains, levers, clutches, solenoids and so forth which are arranged in a compact manner at the outer side of side frame 1A.

In the serial printer of the invention, these rotary shafts are adapted to be rotated selectively by a single common D.C. motor 2, in order to save electric power and to reduce the number of driving power sources. Namely, as will be explained later in more detail, the rotation of the type wheel group (type carrier), vertical shift of the same, and the hammering, carriage shifting and paper feeding functions are achieved by the power derived from this single D.C. motor 2. The D.C. motor 2 is attached to the side frame 1A at the lower side of paper guide plate 3B extending between the side frames 1A,1B, and is adapted to be driven by the electric power supplied from dry cell batteries 4 which are detachably secured also to the lower side of the paper guide plate 3B.

Between the side frames 1A,1B, is disposed a carriage 7 which is guided and held by guide shafts 5,6 extended and fixed between the side frames 1A,1B. The carriage 7 is normally biased in the direction of the arrow A in FIG. 1, i.e. toward the home position, by means of a coiled spring 10′ which is retained at its one end by the side frame 1A and at its other end by a side plate 8 of the carriage 7.

Figure 3:
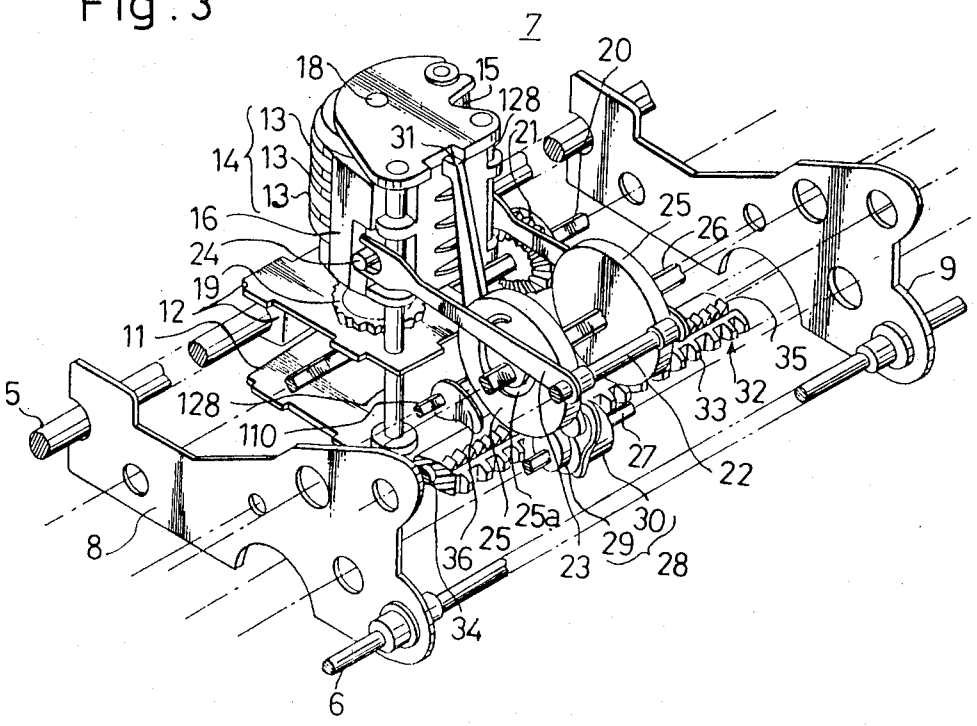
FIG. 3 is a partly exploded perspective view of a carriage incorporated in a serial printer of the invention.

As will be seen from FIG. 3, the carriage 7 is constituted by side plates 8,9, a bottom plate 11 interconnecting the side plates 8,9 and an intermediate plate 12. A type wheel group or type carrier 14 having four stages of type wheels 13 is mounted on the intermediate plate 12 for free rotary and vertical movements. The type carrier 14 is adapted to be moved by being shifted up and down together with a holder 16 which holds the type carrier 14 together with an ink roller 15. The type wheels 13 are jointed together by Oldham's joint which will be described later, and are movable toward the platen 17 independently of one another. Each type wheel 13 is splined to a common type wheel shaft 18 so as to be rotated unitarily with the latter but to move freely in the axial direction, through the medium of a bobbin which will be described later. The type wheel shaft 18 is rotatably carried by the intermediate plate 12 of the carriage. A bevel gear 19 fixed to the type wheel shaft 18 meshes with a bevel gear 21 splined to a character selecting shaft 20 which will be referred to as CS shaft, hereinafter, so that the torque of the CS shaft 20, which is selectively driven by the motor 2, is transmitted to the type carrier 14. The CS shaft 20 is rotatably carried by the side frames 1A,1B and extends past the carriage 7. Gears, cams and clutches which will be mentioned later are mounted on the portion of the CS shaft 20 projected beyond the side frame 1A. The aforementioned bevel gear 21 slides along the CS shaft as a unit with the carriage 7.

A support shaft 22 is secured between the side plates 8,9 of the carriage 7, and supports one end of each of the two shift levers 23,23. The arrangement is such that the type carrier 14 is shifted up and down by the rotation of the shift levers 23.

Namely, the shift levers 23 engages at their other end with respective projections 24 of the holder 16 of the type carrier 14, while another projection formed at an intermediate portion of each lever 23 is in engagement with a spiral cam groove 25*a* of a respective shift cam 25. The shift levers 23 are rotatively driven by the shift cams 25 which in turn are driven selectively by the motor 2, thereby to shift the type carrier 14 up and down. The shift cams 25 are splined to a type wheel spindle 26 (referred to as WS shaft, hereinafter) and are shifted as a unit with the carriage 7. The WS shaft 26 is rotatably held by the side frames 1A,1B through the carriage 7. A later-mentioned gear and cam are mounted on the portion of the WS shaft 26 projected beyond the side frame 1A to selectively rotate the WS shaft 26.

A rotary shaft 27 for effecting carriage shifting and hammer actuation (this shaft will be referred to as CA.H shaft, hereinafter) is rotatably held by the side frames 1A,1B, and extends through the carriage 7. A carriage shifting and hammer actuating cam 28 (referred to as CA.H cam, hereinafter) adapted to be shifted as a unit with the carriage 7 is splined to the CA.H shaft 27. The arrangement is such that, as the CA.H cam 28 rotates, it actuates a hammer 31 carried by the carriage 7 to force one of the type wheels 13 outwardly toward the platen 17 to effect printing and, as a result of the subsequent rotation of the CA.H cam 28, the carriage 7 is shifted by a predetermined amount along the direction of a line to be printed. Namely, a rack member 32 is disposed along the path of movement of the carriage 7 at the lower side of the carriage 7. The rack member 32 has rack teeth 33 engaged by specially-shaped screw teeth (mentioned later) of the CA.H cam 28. The CA.H cam moves along the rack member 32 at each rotation by a predetermined amount of rotation, thereby to effect shifting of the carriage 7.

A gear attached to one end of the CA.H shaft projected beyond the side frame 1A is operatively connected to the output shaft of the motor 2 through a gear train and a clutch. This arrangement will be explained later in more detail.

A shaft 34 extending through the rack member 32 and rotatable as a unit with the latter is adapted to cause a resetting of the carriage 7 to the home position (carriage return) or to effect a back spacing of the carriage 7, depending on the amount of rotation thereof. This shaft 34 will be referred to as CR.BS shaft, hereinafter. The CR.BS shaft 34 is supported between the side frames 1A,1B and carries, at its end projected beyond the side frame 1A, a gear and other associated members. This shaft 34 is adapted to rotate only when a later-mentioned cam-lever group takes a predetermined state of operation. Namely, when the CR.BS shaft rotates by a large amount, the distance between the rack teeth 33 of the rack member 32 and the screw teeth of the CA.H cam is increased, so that the carriage 7 is freed to move back to the home position by the force of the coiled spring 10. On the other hand, when the amount of rotation of the CR.BS shaft is small, the rack teeth of the rack member 32 and the screw teeth of the CA.H cam 28 are dis-engaged to permit the carriage to a back space by a predetermined distance until one of the saw-teeth-like projection 35 on the upper part of the rack member 35 comes into engagement with the claw 36 of the carriage 7. This operation will be explained later in more detail.

Referring again to FIG. 1, paper feed rollers 38 and idle rollers 39 resiliently biased into contact with the rollers 38 are disposed at the inner side of a paper passage which is defined by the two paper guide plates 3A,3B. The paper feed rollers 38 are attached to a paper feed shaft 37 which will be referred to as PF shaft, hereinafter.

The paper is pinched between these rollers 38,39 and is fed as the paper feed rollers 38 rotate, into the gap between the platen 17 and the type carrier 14 while being suitably guided by the paper guide means. The PF shaft 37 is rotatably carried by the side frames 1A,1B. A gear attached to one end of the PF shaft projecting beyond the side frame 1A is operatively connected to the rotor shaft of the motor 2 through a gear train and a clutch. This shaft is driven by the motor 2 only when the later-mentioned cam-lever group takes a predetermined state of operation, as will be described below.

The rotor shaft of the motor 2 is operatively connected to a drive gear 40 at the outside of the side frame 1A through a gear train (not shown) disposed at the inside of the side frame 1A. The aforementioned CS shaft 20, WS shaft 26, CA.H shaft 27 and the PF shaft 37 are operatively connected to the drive gear 40 through respective gear trains and clutches. These shafts are selectively driven by the power of the motor 2 by combined operation of later-mentioned solenoids, levers, cams and clutches, while the rotation of the CR.BS shaft is controlled by cams and levers. At the right front part of FIG. 1 (outside of the side frame 1A), there are shown gears, levers, cams, clutches and solenoids for controlling the operation of the shafts mentioned above. In FIG. 1, however, some members are hidden behind other members. Therefore, the detailed explanation of this mechanism will be made later in connection with FIG. 2, as well as Figures explanatory of operation of respective parts. Thus, FIG. 1 gives only the concept of general arrangement explained heretofore.

GENERAL OPERATION

The general operation of the serial printer of this embodiment will be explained briefly. The torque of the motor 2 is transmitted to the CS shaft 20 and the WS shaft 26 through a gear train and clutch, so that the type carrier 14 may be shifted up and down and also rotated. The type carrier 14 is stopped when the desired type element or character takes the printing position opposing the platen 17. This stopping operation is made by placing the clutch between the motor 2 and the CS shaft 20 and the clutch between the motor 2 and the WS shaft 26 into their off states, i.e. into a state where no torque transmission can be transmitted from the gear 40 driven by the motor 2, by operating these clutches by levers which in turn are actuated by solenoids.

As both the CS shaft 20 and the WS shaft 26 stop rotating, the clutch for controlling the torque transmission between the motor 2 and the CA.H shaft 27 is turned into on state, i.e. into the state of torque transmission, by the operation of cams and levers, and the CA.H shaft makes one revolution by the power of the motor. As a result of the rotation of the CA.H shaft 27, the CA.H cam 28 is rotated. The hammer 31 is actuated during the earlier half part of rotation of the CA.H cam 28 to press selected type element of the type wheels 13 against the platen 17 to effect printing. Then, by the later half part of the rotation of the CA.H cam 28, shifting of the carriage 7 through the cooperation between the screw teeth and the rack teeth 33 is carried out.

After full one rotation of the CA.H shaft 27, the clutches between the motor 2 and the CS shaft 20 and WS shaft 26 are turned on, while the clutch between the motor 2 and the CA.H shaft 27 is turned off to permit the selection of a type character for the next printing position. Thereafter, the type carrier is shifted up or down and rotated to bring the next type character to the printing position, and then, after the stopping of the type carrier 14, hammering and shifting (stepping) of the carriage 7 are performed in the same manner as explained before.

After the completion of the typing of one line, or when it is desired to return the carriage 7 to the home position from an intermediate position in a line, the WS shaft 26 is made to select and stop at a position for setting the type carrier 14 at a specific position in the lowermost stage. When the type carrier 14 takes this position, the hammer cannot drive the type wheel, and the printed data on the paper is visible. This specific position, therefore, will be referred to as visible position. At the same time, the type carrier 14, i.e. the CS shaft 20 is made to select a first specific position (referred to as carriage return position, hereinafter) and to stop at this position.

As the CS shaft 20 and the WS shaft stop rotating, cams unitary with these shafts are also made to stop at specific positions. On the other hand, as both shafts 20,26 stop at the selected specific positions, a clutch is activated to permit the motor 2 to drive another cam. This cam cooperates with the cams on the CS shaft 20 and the WS shaft 26 in actuating a lever which in turn acts to rotate the CR.BS shaft 34 by a large amount. In consequence, the rack member 32 and the CA.H cam 28 of the carriage 7 are dis-engaged so that the carriage 7 is returned to the home position by the force of the coiled spring 10.

The back spacing operation of the carriage 7 is made substantially in the same manner as the carriage returning operation explained above. Namely, the cams on the CS shaft 20 and the WS shaft 26 are made to stop at specific positions after selection and stopping of the type carrier 14 at the visible position and selection and stopping of the type carrier 14 (CS shaft 20) at a second specific position which will be referred to as back spacing position.

As the shafts 20 and 26 stop at the selected positions, a clutch is activated to permit a cam to rotate. This cam cooperates with the cams on both shafts 20,26 to actuate a lever which in turn acts to rotate the CR.BS shaft 34 by a small amount.

This rotation of the CR.BS shaft 34 causes the rack teeth 33 of the rack member 32 to be disengaged from the screw teeth of the CA.H cam 28, so that the carriage 7 starts to move toward the home position by the force of the coiled spring 10. However, in this case, a saw-tooth-like projection 35 of the rack member 32 is engaged by the claw 36 of the carriage 7 so that the latter is made to stop after moving a distance corresponding to ½ pitch of the normal spacing between printed characters. This back spacing operation by ½ pitch is repeated until the carriage 7 is returned to the desired position.

The arrangement is such that the shifting of the carriage in the forward direction, immediately after a back spacing of the carriage 7, is increased to compensate for the back spacing operation. A detailed description will be made later in this connection.

As to the paper feed operation, the WS shaft is made to select and stop at the visible position, while the type wheel shaft (CS shaft 20) is made to select and stop at a third specific position which will be referred to as paper feed position hereinafter.

In consequence, the cams on the CS shaft 20 and the WS shaft 26 are made to stop at specific positions. On the other hand, a clutch which is activated by the stopping of the shafts 20,26 at specific positions acts to rotate another cam which cooperates with cams on the shafts 20,26 to activated a clutch between the motor 2 and the PF shaft 37, so that the power of the motor 2 is transmitted to the PF shaft 37 to feed the paper by a predetermined distance.

For continuously feeding the paper, the operation explained above is repeated until the paper is fed by the required amount.

RELATION BETWEEN MOTOR AND SHAFTS

Figure 2:
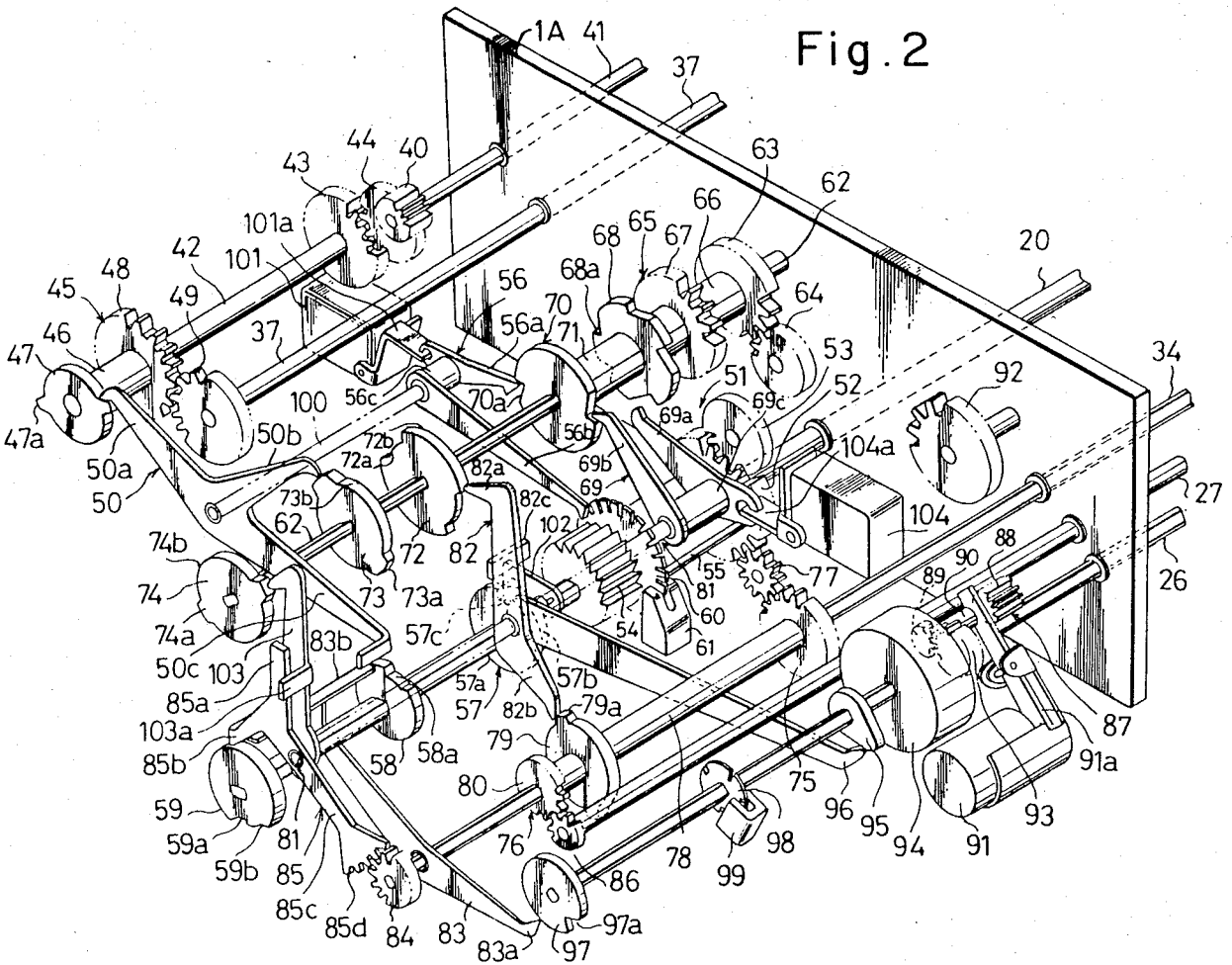
FIG. 2 is a schematic view partially exaggerated to show how a motor is associated with various rotary shafts, cams, levers and so forth in the serial printer of the invention.

FIG. 2 is a partly simplified perspective view of the gears, cams, levers, clutches and solenoids which are arranged at the outer side of the side frame 1A shown in FIG. 1. For the clarification of the illustration, the positional relationship of the shafts is shown a somewhat different manner from the actual positional relationship, and the shaft lengths and lever lengths are illustrated in a somewhat exaggerated manner. This Figure, however, correctly shows the basic arrangement and operation.

More specifically, FIG. 2 shows the mechanism for the selective torque transmission between the motor 2 and the aforementioned shafts such as CS shaft 20, WS shaft 26, CA.H shaft 27 and the PF shaft 37, as well as the selective rotary motion of the CR.BS shaft 34.

Before turning to the detailed description of construction and operation of each part, a general description will be made with reference to FIG. 2.

In FIG. 2, reference numeral 40 designates a drive gear which is rotated constantly in the counterclockwise direction by the motor 2 when the latter is energized. A drive shaft 41 is rotatably carried by the side frame 1A and is adapted to rotate together with the drive gear 40. A reference numeral 42 designates a paper feed control cam shaft (referred to as PFC shaft, hereinafter) which is also rotatably carried by the side frame 1A. A gear 43 fixed to the PFC shaft 42 is engaged by an idle gear 44 which in turn is engaged by the aforementioned drive gear 40, so that the gear 43 rotates constantly in the counterclockwise direction by the operation of the motor 2. A reference numeral 45 designates a paper feed intermediate rotary member which is carried by the PFC shaft 42 in such a manner as to be able to rotate independently of the latter. A first clutch (claw clutch) 46 is connected between the PFC shaft 42 and the intermediate rotary member 45 to enable a selective torque transmission therebetween.

The paper feed intermediate rotary member 45 is provided with a paper feed control cam (referred to as PF cam, hereinafter) 47 and a gear 48. The gear 48 meshes with the gear 49 on the PF shaft 37 to which is attached the aforementioned paper feed roller 38. Two cam projections **47*a* are formed on the outer peripheral surface of the PF cam 47 at a 180° interval. The arrangement is such that the first clutch 46 takes the off state when a latermentioned paper feed control lever 50 (referred to as PF lever, hereinafter) is kept in contact with a cam projection 47*a*, whereas, when the PF lever is out of engagement with the cam projection 47*a*, the first clutch 46 takes the on state to permit the torque of the motor 2 to be transmitted to the gear 49 of the PF shaft 37, through the drive gear 40, idle gear 44, gear 43, PFC shaft 42 and then through the paper feed intermediate rotary member 45**, thereby to effect the paper feed.

The CS shaft 20 for rotatively driving the type carrier 14 carries at its one end adjacent to the side frame 1A a gear body 51 in such a manner that the gear body 51 is rotatable independently of the CS shaft 20. The gear body 51 has a gear 52 which is operatively connected to the drive gear 40 through the idle gear 53 as shown in FIG. 1 so as to be rotated constantly in the counterclockwise direction as viewed in FIG. 2 by the power of the motor 2. A reference numeral 54 designates a ratchet fixed to the CS shaft 20. A spring clutch forms a second clutch 55 connected between the ratchet 54 and the gear body 51 to make selective torque transmission therebetween. The number of teeth of the ratchet 54 corresponds to the number of type characters formed at a constant pitch on the periphery of the type wheels 13. The arrangement is such that a later-mentioned type selection lever **56*b* (referred to as CS lever, hereinafter) is receivable within the valleys between teeth of the ratchet 54**.

The second clutch 55 is kept in its on state when the CS lever **56*b* is out of engagement with the teeth of the ratchet 54, so that the torque of the motor 2 is transmitted to the ratchet 54, i.e. CS shaft 20, through the gear 53 and the gear body 51, thereby to rotate the type wheels 13. To the contrary, when the ratchet 56 is placed in engagement with the teeth of the ratchet 54, the ratchet 54 is prevented from being rotated, so that the second clutch 55 is turned off immediately to interrupt the torque transmission between the gear body 51 and the CS shaft 20, i.e. ratchet 54**.

A first, second and a third CS shaft cams 57,58 and 59 are fixed to the CS shaft 20. The first CS shaft cam 57 is related to the driving of the hammer 31, while the second one 58 is concerned with the feeding of paper. Finally, the third CS shaft cam 59 take part in the returning and back spacing operation of the carriage.

The first CS shaft cam 57 is provided with a large-diameter portion **57*a* and a small-diameter portion 57*b*. A cam groove 57*c* is formed in this large-diameter portion. Similarly, the second CS shaft cam 58 has a cam groove 58*a*, while the third CS shaft cam 59 is provided with a first and a second cam grooves 59*a*,59*b*. The first cam groove 59*a* of tht third CS shaft cam 59 has a greater depth than the second cam groove 59*b* of the same. The first and the second cam grooves 59*a* and 59*b* relate to the carriage returning operation and the back spacing operation, respectively. The cam grooves 57*c*,58*a*,59*a* and 59*b* of the first to third CS shaft cams 57 to 59 are formed with a suitable phase difference and are not aligned when viewed in the axial direction. A detection plate 60 is adapted to rotate as a unit with the ratchet 54, i.e. the CS shaft 20, and has slits corresponding to the stopping positions of the type wheel 13. This detection plate 60 cooperates with a detector 61 having a light emitting and receiving elements to detect the rotational position of the type wheel 13**, as well as the rotational reference position, as is well understood in the art.

A reference numeral 62 designates a control cam shaft (referred to as CC shaft, hereinafter) rotatably carried by the side frame 1A. A gear 63 carried by the CC shaft 62 is rotatably independently of the latter. The gear 63 is operatively engaged by the gear 52 of a gear body on the CS shaft 20, through an idle gear 64, so that the gear 63 is rotated constantly in the counter-clockwise direction as viewed in FIG. 2, by the motor 2 through the gear train 40,53, 52,64 as shown in FIG. 1.

A reference numeral 65 designates a rotary member (referred to as WSS rotary member) for selecting the shift position of the type wheel, and carried by the CC shaft 62 in such a manner as to be able to rotate independently of the latter. This WSS rotary member is connected to the aforementioned gear 62 through the medium of a third clutch 66 which is also a spring clutch and controls the torque transmission therebetween. The WSS rotary member 65 is provided with a gear 67 and a cam 68 for selecting the shift position of the type wheels. The cam 68 will be referred to as WSS cam, hereinafter. The cam 68 is provided with 5 (five) equispaced cam grooves **68*a*, so as to permit the type carrier 14 to select one of five shift positions by the operation of the cam 68**.

The cam grooves **68*a* of the cam 68 are adapted to be engaged by a later-mentioned type wheel shift position selecting lever 69 (referred to as WS lever, hereinafter). When the WS lever 69 is kept out of engagement with the cam grooves 68*a*, the third clutch 36 takes the on state, so that the WSS rotary member 65 rotates as a unit with the gear 63 which in turn is adapted to be driven by the motor 2. To the contrary, when the WS lever 69 is in engagement with the cam groove 68*a*, the WSS cam 68 is prevented from being rotated so that the aforementioned third clutch is turned off immediately to interrupt the torque transmission between the gear 63 and the WSS rotary member 65**.

A reference numeral 70 designates a first CC shaft cam fixed to the CC shaft 62 and operatively connected to the aforementioned gear 63 through a spring clutch formed by the fourth clutch 71 for making a selective torque transmission therebetween. Although the illustration of this clutch is simplified, this clutch can easily be mounted by inserting the hollow shaft portion of the first CC shaft cam 70 or the hollow shaft of the gear 63 through the WSS rotary member 65. The first CC shaft cam 70 is provided with two cam grooves **70*a*,70*a* at an 180° interval. These cam grooves 70*a*,70*a* are adapted to be engaged by a part of the CS lever 56 and a part of the WS lever 69, respectively. The fourth clutch 71 takes the on state only when both of the levers 56,69 are out of engagement with the associated cam grooves 70*a*,70*a*, thereby to transmit the torque to the first CC shaft cam 70, i.e. the CC shaft 62, from the gear 63 which is constantly driven by the motor 2**.

When either one of the cam grooves **70*a*,70*a* is engaged by the associated lever, i.e. the CS lever 56 or the WS lever 69, the fourth clutch 71 takes the off state so that the torque transmission between the gear 63 and the CC shaft 62, i.e. the first CC cam shaft 70**, is interrupted.

A second, third and fourth CC shaft cams 72, 73,74 are fixed to the CC shaft 62 in addition to the first CC shaft cam 70. The second CC shaft cam 72 together with the first CC shaft cam 70 takes part in the driving of the hammer 31 and the feeding of the carriage 7. The third and fourth CC shaft cams 73 and 74 relate to the returning and back spacing of the carriage, respectively. The second CC shaft cam 72 is provided with two cam grooves **72*a* formed an 180° interval. These cam grooves 72*a*,72*a* are formed at a small phase difference from the cam grooves 70*a*,70*a* of the first CC shaft cam 70. Also, the third and fourth CC shaft cams 73 and 74 are provided with pairs of cam projections 73*a*,73*a* and 74*a*,74*a* at 180° intervals, respectively. The cam projections 73*a* of the cam 73 are offset from the cam projections 74*a* of the cam 74**.

The rack body 32 is attached to the CR.BS shaft 34 which carries also a gear 75 and a carriage-shift hammering control intermediate rotary member 76 (referred to as CA.H intermediate rotary member) in such a manner that the gear 75 and the rotary member 76 are rotatable independently of the shaft 34.

The gear 75 engages through an idle gear 77 with the gear 52 of the gear body 51 on the CS shaft 20, so as to be rotated constantly in the counter-clockwise direction as viewed in FIG. 2 by the gear 51 which in turn is continuously driven by the motor 2.

A spring clutch forms a fifth clutch 78 connected between the gear 75 and the CA.H intermediate rotary member 76 to control the torque transmission therebetween.

The CA.H intermediate rotary member 76 is provided with a CA.H control cam 79 and a gear 80, while the CA.H control cam 79 is provided with two cam projections 79*a*, 79*a* spaced at a 180° interval. The cam projections 79*a* are adapted to be engaged by one end of a third lever 82 of a later-mentioned lever shaft 81. The arrangement is such that, when the third lever 82 is out of engagement with the cam projection 79*a*, the fifth clutch 78 takes the on state, so that the CA.H intermediate rotary member 76 rotates as a unit with the gear 75. To the contrary, when the third lever 82 abuts the cam projection 79*a* to prevent the CA.H control cam 79, i.e. the CA.H intermediate rotary member 76, from rotating, the fifth clutch 78 is turned off without delay to interrupt the torque transmission between the gear 75 and the CA.H intermediate rotary member 76.

A later-mentioned stopper lever 83 is rotatably held at the end portion of the CR.BS shaft 34, while a gear 84 is fixed to the endmost portion of the same shaft 34. The gear 84 meshes with a sector gear 85*d* provided at the end of a later-mentioned fifth lever of the lever shaft 81. Therefore, the CR.BS shaft 34 is rotated as the fifth lever 85 rotates, thereby to effect the returning of the carriage 7 or the back spacing of the same.

The gear 80 of the CA.H intermediate rotary member 76 on the CR.BS shaft 34 engages with the gear 86 fixed to the CA.H shaft 27, so that the torque of the motor 2 is transmitted to the CA.H shaft 27 to effect the hammering operation and the carriage shifting operation only when the fifth clutch 78 takes the on state.

A reference numeral 87 designates a switching gear body for selecting the direction of shifting of the type carrier 14. The switching gear body 87 is carried rotatably and axially movably over a limited stroke by a support shaft (not shown) fixed to the side frame 1A. The switching gear body 87 is provided at its both ends with gears 88,89 and a connecting portion 90 therebetween. A solenoid 91 for switching between the forward and backward rotation (referred to as switching solenoid, hereinafter) has an actuating piece 91*a* attached to the connecting portion 90. The above-mentioned actuating piece 91*a* is biased by a spring (not shown) toward the side frame 1A, so that the switching gear body 87 is biased also toward the side frame 1A when the switching solenoid 91 is not energized.

Gear 88 of the switching gear body 87 is operatively connected to the gear 67 of the WSS rotary member 65 on the CC shaft 62, through an idle gear 92. The idle gear 92 is kept in engagement with the gear 88 wherever the switching gear body 87 is located within the axial stroke thereof. Therefore, as the third clutch 66 is turned on to permit the WSS rotary member 65 to be driven by the motor 2, the switching gear body 87 is rotated in the counterclockwise direction as viewed in FIG. 2 together with the WSS rotary member 65. A gear 93 and an internally toothed gear 94 are fixed to the WS shaft 26 which in turn is splined to the shift cams 25. The gear 89 of the switching gear body 87 is adapted to engage selectively one of the gears 93 and 94. More specifically, when the switching solenoid 91 is de-energized, the switching gear body 87 takes a position adjacent to the side frame 1A, so that the gear 89 engages with the gear 93 to make the WS shaft 26 rotate in the counter-clockwise direction as viewed in FIG. 2, as the switching gear body 87 rotates. To the contrary, when the switching solenoid 91 is energized, the switching gear body 87 is moved away from the side frame 1A, so that the gear 89 engages with the internally toothed gear 94 to make the WS shaft 26 rotate in the clockwise direction as viewed in FIG. 2 as the switching gear body 87 is rotated.

A reference numeral 95 designates a first WS shaft cam fixed to the WS shaft 26, and adapted to control the second lever 96 of the later-mentioned lever shaft 81 upon contact with the second lever 96, while a reference numeral 97 denotes a second WS shaft cam fixed to the WS shaft 26 and adapted to be contacted by one end of the stopper lever 83. The second WS shaft cam 97 is provided with a cam groove 97*a*. The arrangement is such that, when the WS shaft 26 is stopped at a rotational position corresponding to the visible position of the type carrier 14, the stopper lever 83 is received at its one end within the cam groove 97*a*. A detection plate 98 fixed to the WS shaft 26 cooperates with a detector 99 having a light emitting and light receiving elements to detect the position of shift of the type carrier 14.

The CS lever 56 and the PF lever 50 are rotatably carried by a support shaft 100 fixed to the side frame 1A. The CS lever 56 is provided with two lever portions 56*a*,56*b* and an intermediate connecting portion 56*c*. A solenoid 101 for stopping the rotation of the type wheel (referred to as CS solenoid, hereinafter) has an actuating piece 101*a* fixed to the base portion of the CS lever 56. The actuating piece 101*a* is biased by a spring (not shown) such that is is rotated counterclockwise as viewed in FIG. 2 when the CS solenoid 101 is not energized, to make contact at its end with the first CC shaft cam 70. When the lever portion 56*a* is received by the cam groove 70*a* of the first CC shaft cam 70, the end of the other lever portion 56*b* is held out of engagement with the ratchet 54 of the aforementioned CS shaft 20, so that the second clutch 55 takes the on state to permit the CS shaft 20 to be driven by the motor 2.

On the other hand, as the CS lever 56 is rotated clockwise as viewed in FIG. 2 as a result of energization of the CS solenoid 101, the lever portion 56*a* is moved out of engagement with the cam groove 70*a* of the first CC shaft cam 70, while the lever portion 56*b* is brought into engagement with the ratchet 54, so that the second clutch 55 is turned off to stop the CS shaft 20, thereby to make the type wheel 13 stop at its rotational position selected. Then, as the lever portion 56*a* is moved out of engagement with the cam groove 70*a*, the first CC shaft cam 70 is made to rotate by a small rotation angle even if the WS lever 69*b* is positioned in the other cam groove 70*a* of the CC shaft cam 70, because of operation of a mechanism which be described later. Therefore, even when CS solenoid 101 is de-energized, the end of the lever portion 56*a* rides on the circular periphery of the first CC cam 70 and the other lever portion 56*b* is held in engagement with the ratchet 54. This state is maintained until the lever portion 56*a* is forced by the spring force into the next cam groove 70*a* as a result of 180° rotation of the first CC shaft cam 70. Then, simultaneously with the dropping of the lever portion 56*a* in the cam groove 70*a*, the lever portion 56*b* is disengaged from the ratchet 54 so that the second clutch 55 is turned on without delay.

The PF lever 50 has a form of generally three branches or fingers and is supported at its mid portion by the support shaft 100. The PF lever 50 is biased by a spring (not shown) in the clockwise direction as viewed in FIG. 2. The lever portions 50*a*, 50*b* and 50*c* of the PF lever 50 are related, respectively, to the PF cam 47 on the PFC shaft 42, third CC shaft cam 73 on the CC shaft 62 and the second CS shaft cam 58 on the CS shaft 20 and the stopper lever 83. When the stopper lever 83 is in the a position where it cannot fit in the cam groove 97*a* of the second WS shaft cam 97 of the WS shaft 26, the lever portion 50*c* contacts the stopper lever 83 while the lever portion 50*a* contacts the cam projection 47*a* of the PF cam 47. Also, the lever portion 50*b* in this state takes a position where it contacts the cam projection 73*a* of the third CC shaft cam 73, i.e. a position where it cannot engage the cam groove 73*b* between two cam projections 73*a*.

The stopper lever 83 is biased counter-clockwise as viewed in FIG. 2 by a spring which is not shown, such that a projection 83*a* formed at one end thereof contacts the outer periphery of the second WS shaft cam 97, while a stopper piece 83*b* is formed at the other end in a T-shape and is adapted to engage the PF lever 50 through lever portion 50*c* and fifth lever 85 of the later-mentioned lever shaft 81. Therefore, when the projection 83*a* of the stopper lever 83 engages the circular outer peripheral portion of the WS shaft cam 97 prevents the PF lever from rotating. However, when the WS shaft 26 makes a stop at the visible position, the projection 83*a* comes into the cam groove 97*a* of the second WS shaft cam 97, so that the stopper piece 83*b* of the stopper lever 83 is moved away from the lever portion 50*c* of the PF cam 50. In consequence, the CS shaft 20 is stopped at such a position as to make the cam groove 58*a* of the second CS shaft cam oppose the lever portion 50*c* of the PF lever 50. In this state, the CC shaft 62 is rotated to permit the lever portion 50*b* of the PF lever 50 to drop into the cam groove 73*b* of the third CC shaft cam 73 by the force of the spring. Simultaneously, the lever portion 50*a* is moved away from the cam projection 47*a* of the PF cam 47. As the PF lever 50 is disengaged from the PF cam 47, the first clutch 46 is turned on to transmit the rotation of the PFC shaft 43 through the intermediate rotary member 45 to the PF shaft 37 thereby to effect the paper feeding operation.

On the other hand, the third CC shaft cam 73 has stopped after resetting the lever portion 50*a* of the PF lever 50 to a position for contacting the cam projection 47*a*, overcoming the force of the spring, before the PF cam 47 makes a half rotation. Thus, as the PF cam 47 makes a half rotation, the lever portion 50*a* makes a contact with the cam projection 47*a* to turn the first clutch 46 off thereby to stop the PF shaft 37. Needless to say, in this state, the lever portion 50*c* of the PF lever 50 is out of engagement with the cam groove 58*a* of the second CS shaft cam 58.

A reference numeral 81 designates a lever shaft to which are rotatably attached the WS lever 69, first lever 102, second lever 96, third lever 82, fourth lever 103, and the fifth lever 85, in the mentioned order as viewed from the side frame 1A toward the end of the lever shaft 81.

The WS lever 69 has lever portions 69*a*, 69*b* and intermediate connecting portion 69*c*. To the base portion of the WS lever 69, is attached an actuating piece 104*a* of a solenoid 104 for selecting the shift position of the type carrier 14. This solenoid 104 will be referred to as WS solenoid, hereinunder.

The actuating piece 104*a* is biased by a spring (not shown) in such a direction that the WS lever is rotated clockwise as viewed in FIG. 2 when the WS solenoid 104 is not energized. In this state, the end of the lever portion 69*a* is received by the cam groove 68*a* of the WS cam 68 on the CC shaft 62, while the end of the other lever portion 69*b* is kept out of engagement with the cam groove 70*a* of the first CC shaft cam 70. Therefore, the WSS cam 68 is prevented from rotating so that the third clutch 66 is kept in the off state to prevent the torque of the motor 2 from being transmitted to the WS shaft 26. However, as the WS solenoid 104 is energized, the WS lever 69 is rotated in the counter-clockwise direction as viewed in FIG. 2, so that the lever portion 69*a* comes out of engagement with the cam groove 68*a* of the WSS cam 68, while the end of the lever portion 69*b* drops into the cam groove 70*a* of the first CC shaft cam 70. In this state, the lever portion 69*b* is slightly spaced from the vertical end surface of the cam groove 70*a*, so that the first CC shaft cam 70 is rotatable by a small amount as the CS lever 56 is disengaged from the cam groove 70*a*.

As the WSS cam 68 is released from the lever portion 69*a* for free rotation, the third clutch 66 is turned on to permit the torque of the motor 2 to be transmitted to the WS shaft 26 through the WSS rotary member 65, so that the WS shaft 26 is rotated forwardly or backwardly depending on the position of the switching gear body 87 thereby to shift the type carrier 14 up or down.

In synchronism with the shifting of the type carrier 14 to the desired position, the power supply to the WS solenoid 104 is interrupted to permit the WS lever 69 to be rotated clockwise by the force of the spring, so that the lever portion 69*b* is disengaged from the cam groove 70*a* of the first CC cam 70, while the lever portion 69*a* drops into the cam groove 68*a* of the WSS cam 68 to prevent the latter from rotating. In consequence, the third clutch 66 is turned off to stop the WS shaft 26 without delay thereby to make the type carrier 14 stop at the desired shift position.

The first and second levers 102 and 96 are carried by the lever shaft 81 in such a manner so as to be able to move in the axial direction by a predetermined distance, and are biased resiliently toward the third lever 82 by a spring which is not shown. An end surface cam is provided on the contact surface between the second lever 96 and the third lever 82, while the first lever 102 is adapted to be rotated as a unit with the second lever 96 as the latter is rotated. Namely, the end of the second lever 102 is biased counter-clockwise by the spring (not shown) continuously in contact with the outer peripheral surface of the first WS shaft cam 95 on the WS shaft 26, so that the top portion of the first WS shaft cam 95 biases the second lever 96 counter-clockwise only when the WS shaft 26 takes a position corresponding to the visible position. The clockwise rotation of the second lever 96 causes the second lever 96 and the first lever 102 to be slid toward the third lever 82 by the action of the end surface cam. The second lever 96 is rotated counter-clockwise by the force of the spring as the WS shaft comes out of its position corresponding to the visible position, so that the first and second levers 102, 96 are slid toward the side frame 1A.

The first lever 102 is biased clockwise as viewed in FIG. 2 by the force of a spring (not shown), and is prevented from rotating by a bend 82*c* of the third lever 82. When the lever 102 takes the position adjacent to the side frame 1A, it opposes the small-diameter portion 57*b* of the first CS shaft cam 57 with a small gap therebetween, whereas, when the lever 102 is located at the same side as the third lever 83, it contacts the circular peripheral portion of the large-diameter portion 57*a* of the first CS shaft cam 57. Thus, when the first lever 102 takes a position opposing the small-diameter portion 57*b*, it permits the third lever 82 to be rotated counter-clockwise irrespective of the rotational position of the CS shaft 20. When the first lever 102 is in contact with the outer periphery of the large-diameter portion 57*a*, the counter-clockwise rotation of the third lever 82 as viewed in FIG. 2 is permitted only when the CS shaft 20 takes such a position that the cam groove 57*c* of the large-diameter portion 57*a* and the end of the first lever 102 oppose each other. Namely, the counter-clockwise rotation of the third lever 82 is prevented when the CS shaft 20 takes a rotational position other than that mentioned above.

The third lever 82 is provided with lever portions 82*a*,82*b* and a bend 82*c* formed on the lever portion 82*a*, and is rotatively biased in the counter-clockwise direction by a spring which is not shown. When the CC shaft 62 is kept stationary, the lever portion 82*a* contacts at its end with the cam projection 72*b* of the second CC shaft cam 72, while the end of the other lever portion 82*b* is in contact with the cam projection 79*a* of the CA.H control cam 79 on the CR.BS shaft 34, thereby to prevent the CA.H control cam from rotating. Therefore, the fifth clutch 78 takes the off state so that the torque of the motor 2 is not transmitted to the CA.H shaft 27. In this state, the third lever 82 cannot rotate counter-clockwise so that the bend 82*c* does not drive the first lever 102 in this direction.

On the other hand, as the CC shaft 62 starts to rotate while the end of the first lever 102 is opposed by the small-diameter portion 57*b* or the cam groove 57*c* of the first CS shaft cam 57, the lever portion 82*a* of the third lever 82 is rotated counter-clockwise with its end dropped into the cam groove 72*a* in accordance with the rotation of the second CC shaft cam 72. In consequence, the first lever 102 is pushed by the third lever 82 and rotated in the counter-clockwise direction while the lever portion 82*b* of the third lever 82 is disengaged from the cam projection 79*a* of the CA.H control cam 79. Although the first and the third levers 102 and 82 are rotatively biased in the opposite directions by the springs, the first lever 102 is easily pressed and rotated by the third lever 82 because the spring biasing the third lever 82 has a greater spring constant than the first lever 102.

Then, as the third lever 82 is disengaged from the CA.H control cam 79, the latter is allowed to rotate so that the fifth clutch 78 is turned on to permit the motor 2 to drive the CA.H shaft 27 through the CA.H control cam 79 (CA.H intermediate rotary member 76) thereby to effect the driving of the hammer 31 and the shifting of the carriage 7 pitch by pitch.

The CC. shaft 62 continuously rotates even during the rotation of the CA.H shaft 27. The rotation of the CC shaft 62 is continued until the CS lever 56 comes into the cam groove 70*a* of the first CC shaft cam 70.

Therefore, before the CC shaft 62 completes ½ rotation, the second CC shaft cam 72 rotating unitarily with the CC shaft 62 brings the end of the lever portion 82*a* of the third lever 82 out of the cam groove 72*a* into contact with the cam projection 72*b* thereby to rotate the third lever 82 counter-clockwise. Consequently, the end of the lever portion 82*b* of the third lever 82 is brought to the position for contacting the cam projection 79*a* of the CA.H cam 79, before the latter completes a ½ rotation. Then, at the moment of completion of the ½ rotation of the cam 79, the lever portion 82*b* is made to contact with the cam projection 79*a* so that the CA.H cam is prevented from rotating, thereby to turn the fifth clutch 78 off to stop the CA.H shaft 27.

Meanwhile, the CA.H shaft completes its rotation. The fourth lever 103 of the lever shaft 81 is rotatively biased by a spring (not shown) in the counter-clockwise direction as viewed in FIG. 2, and is kept in contact with the fourth CC shaft cam 74 on the CC shaft 62 when the latter is in the stopped state.

The fourth lever 103 is provided with a bend 103*a* for pressing the lever portion 85*a* of the later-mentioned fifth lever 85.

The fifth lever 85 on the lever shaft 81 has a form provided with three lever portions and is supported at its central portion by the lever shaft 81. The lever portion 85*a* of the fifth lever 85 is in contact with the bend 103*a* of the fourth lever 103, while another lever portion 85*b* is adapted to make contact with the stopper piece 83*b* of the stopper lever 83 and the third CS shaft cam 59. The last lever portion 85*c* has a sector gear 85*d* meshing with the gear 84 of the CR.BS shaft 34. As mentioned before, when the WS shaft 26 takes a rotational position other than the visible position, the projection 83*a* of the stopper lever 83 contacts the circular outer periphery of the second WS shaft cam 97, so that the stopper piece 83*b* of the stopper lever 83 takes the position for contacting the end of the lever portion 85*b* of the fifth lever 85. Therefore, the fifth lever 85 is prevented from rotating in the counter-clockwise direction as viewed in FIG. 2.

Meanwhile, the WS shaft 26 stops at the position, corresponding to the visible position, so that the projection 83*a* of the stopper lever 83 drops into the cam groove 97*a* of the second WS shaft cam 97 to keep the stopper piece 83*b* of the stopper lever 83 away from the lever portion 85*b* of the fifth lever 85. At the same time, the CS shaft 20 is stopped at a position where the first or second cam groove 59*a* or 59*b* opposes the end of lever portion 85*b* of the fifth lever 85. As the CC shaft 62 rotates in this state, the end of the fourth lever 103 is moved from the cam projection 74*a* into the cam groove 74*b* in accordance with the rotation of the fourth CC shaft cam 74 which rotates as a unit with the CC shaft 62, so that the fourth lever 103 is rotated counter-clockwise as viewed in FIG. 2.

As the fourth lever 103 rotates, it presses the fifth lever 85 to rotate the latter counter-clockwise as viewed in FIG. 2, so that the end portion of the lever portion 85*b* of the fifth lever 85 drops into the first or second cam groove 59*a* or 59*b* of the third CS shaft cam 59. In consequence, the fifth lever 85 is rotated by an amount corresponding to the depth of the cam groove 59*a* or 59*b*, and the sector gear 85*d* of the lever portion 85*c* drives the gear 86 of the CR.BS shaft 34. The rotation of the CR.BS shaft in turn rotates the rack body 32 to permit the returning of the carriage 7 to the home position or the back spacing of the same.

Before making a predetermined rotation (½ rotation) and stopping, the CC shaft 62 resets the fourth lever 103 to a position where the latter rides on the cam projection 74*a* of the fourth CC shaft cam 74 shown in FIG. 2. At the same time, as a result of the rotation of the CS shaft 20 after the stopping of the CC shaft 62, the fifth lever 85 also is returned to the position shown in FIG. 2, out of engagement with the cam groove 59*a* of the third CS shaft cam 59.

As will be clearly understood from the foregoing description, in the serial printer in accordance with the invention, the power of the D.C. motor having a rotor rotating at a high speed always in one direction is selectively transmitted through clutches and gear trains to the CS shaft 20, WS shaft 26, CC shaft 62, CA.H shaft 27 and the PF shaft 37, while the CR.BS shaft 34 is selectively driven by the cooperation of cams and levers. This torque transmission system is schematically illustrated at FIG. 4.

Figure 4:
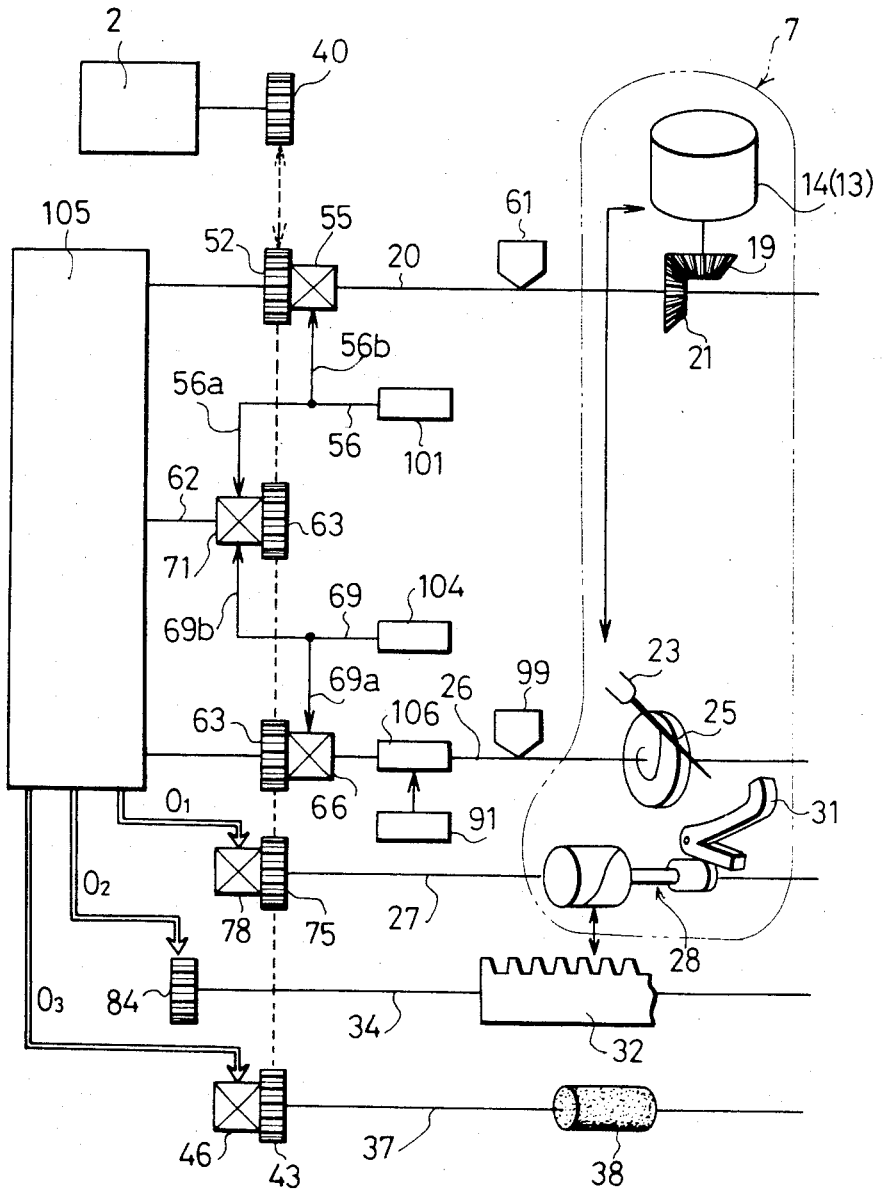
FIG. 4 is a schematic illustration of a torque transmission system between a motor and rotary shafts in a serial printer in accordance with the invention.

Referring to FIG. 4, the drive gear 40 driven by the motor 2 is connecthd to the gears 52,63,75 and 43 for transmitting the torque of the motor 2 to the CS shaft 20, CC shaft 62, WS shaft 26, CA.H shaft 27 and the PF shaft 37, and continuously drives these gears. The second clutch 55 is connected between the gear 52 and the CS shaft 20. Similarly, the fourth clutch 71 is connected between the gear 63 and the CC shaft 62, while the gear 63 and the WS shaft 26 is connected through the third clutch 66. The fifth clutch 78 and the first clutch 46 are connected between the gear 75 and the CA.H shaft 27 and between the gear 43 and the PF shaft 37, respectively, thereby to control the torque trasnmission.

In FIG. 4, a reference numeral 105 generally denotes the cams of the CS shaft 20, cams of the CC shaft 62, cams of the WS shaft 26 and levers associated with these cams. These cams and levers will be generally referred to as cam-lever group 105, hereinafter. A reference numeral 106 designates a switching clutch constituted by the gear 93, internally toothed gear 94 and the switching gear body 87, and adapted to switch the direction of rotation of the WS shaft 26.

The second clutch 55 is controlled by the CS lever 56 which in turn is driven by the CS solenoid 101, while the third clutch 66 is controlled by the WS lever 69 which is driven by the WS solenoid 104. The fourth clutch 71 is under the control of the CS lever 56 and the WS lever 69. Also, the switching clutch 106 is controlled by the switching solenoid 91. The first clutch 46, fifth clutch 78 and the gear 84 of the CR.BS shaft 34 are controlled by the output from the cam-lever group 105.

In the state preparing for printing, all solenoids are kept de-energized, so that the first, third, fourth and fifth clutches 46,66,71 and 78 are kept in then off state, although the second clutch 55 is kept on because the CS solenoid 101 is de-energized.

As the motor 2 is started in accordance with the printing instructions, the CS shaft 20 starts to rotate and the rotational reference position of the same is detected by the detector 61. At the same time, the signals corresponding to respective type characters of the type wheel 13 are detected. Thus, the detection of the rotational position of the type character is effected by a counter which is adapted to be reset by the reference position signal. On the other hand, when the speed of the motor 2 has stabilized, the other detector 99 detects whether the shift position of the type carrier 14 is the visible position or not. If the type carrier 14 is not in the visible position, a sequence is executed to shift the type carrier 14 down by one stage by the later-mentioned shift operation for the type carrier 14. This operation is repeated until the detector 99 detects the type carrier 14 at the visible position. After the detection of the type carrier 14 at the visible position, no detection of position of the type carrier 14 is conducted but the position of the type carrier is calculated by the control circuit which counts the number of up and down shift operations in accordance with the supply of a signal to the switching solenoid 91 and the detection signal from the detector 99. Thereafter, the carriage returning operation and the paper feeding operation are performed, and the resetting of the carriage 7 at the home position is confirmed while the double printing on the paper is avoided.

Then, in accordance with the printing instruction, the printer control circuit judges the necessity for the shift of the type carrier 14, as well as the direction of the shift. If it is necessary to energize the switching solenoid 91 of the switching clutch 106, the switching solenoid 91 is energized from the beginning until the shift is finished. After the completion of the switching clutch 106, the WS solenoid 104 is energized to rotate the WS shaft 26.

Then, as the CS solenoid 101 is energized in accordance with the printing instructions, the supply of the electric power to the WS solenoid 104 is stopped so that the second and the third clutches 55,66 are successively turned off to stop the CS shaft 20 and the WS shaft 26. In consequence, the type carrier 14 is stopped at desired position where the selected type character is located at the printing position.

In the state where the second and third switches 55,66 are turned off, the CS lever 56 and the WS lever 69 are kept out of engagement with the first CC shaft cam 70 for controlling the fourth clutch 71, so that the latter is turned on to rotate the CC shaft 62.

On the other hand, since the printing operation is being made, the WS shaft 26 is not positioned at the visible position and, accordingly, the torque output from the CC shaft 62 is transmitted as the output $0_1$ from the cam-lever group 105 to the fifth clutch 78 to turn the latter on thereby to make the motor 2 to drive the CA.H shaft 27. As the CA.H shaft 27 makes one full rotation, the CA.H cam 28 makes one rotation. In the earlier half part of the rotation, the CA.H cam actuates the hammer 31 and, in the later half part of the rotation, the CA.H cam 28 shifts the carriage 7 along the rack body 32 by one pitch.

As the CA.H shaft 27 completes one rotation, the state shown in FIG. 2 is resumed, in which only the second clutch 55 is held in on state.

For effecting only the shifting of the carriage without any printing operation, the WS shaft 26 selects the visible position, while the CS shaft 20 makes the selection of the spacing position, i.e. the selection of the type character corresponding to the cam groove 57*c* of the first CS shaft cam 57. The rotation of the CC shaft 62 as the output $0_1$ from the cam-lever group 105 acts to turn the fifth clutch 5 on thereby to cause one full rotation of the CA.H shaft. However, since the type carrier 14 takes in this case the position where it is never driven by the hammer 31, i.e. at the visible position, the carriage 7 is shifted by one pitch without making the printing, although the hammer 31 is actuated. When it is necessary to effect a spacing, the abovedescribed operation is repeated. In this operation, the operator can observe and read the data printed on the paper, because the type carrier 14 is positioned at the visible position.

For feeding the paper, the WS shaft 26 selects the visible position, while the CS shaft 20 selects the paper feed position, i.e. the selection of the type character corresponding to the cam groove 58*a* of the second CS shaft cam 58. In consequence, the rotation of the CC shaft 62 is transmitted as the output $0_3$ from the cam-lever group 105 to the first clutch 46 to turn the latter on to rotate the PF shaft 37 by a predetermined amount to shift the paper by ½ pitch. After the rotation of the PF shaft 37 by the amount corresponding to the ½ pitch of paper feed, the printer resumes the initial position shown in FIG. 2 in which only the second clutch 55 takes the on state. For feeding the paper by one pitch, the above-explained operation is conducted twice, while, for feeding the paper continuously, the series of operation stated above is made continuously and repeatedly until the paper is fed by the desired length.

For resetting the carriage 7 to the home position, the WS shaft 26 selects the visible position while the CS shaft 20 takes the carriage return position, i.e. selection of the type character corresponding to the first cam groove 59*a* of the third CS shaft cam 59 of the CS shaft 20. In consequence, the rotation of the CC shaft 62 is transmitted as the output $0_2$ from the cam-lever group 105 to the BR.CS shaft 34 to rotate the latter together with the rack body 32 to dismiss the engagement between the rack teeth 33 of the rack body 32 and the screw teeth of the CA.H cam 28, thereby to rapidly return the carriage 7 to the home position by the force of the coiled spring 10. In this case, before the CC shaft 62 stops after making a predetermined rotation, it acts to reset the associated levers to the initial state. Also, the CS shaft 20 which starts to rotate immediately after the stopping of the CC shaft 62 acts to reset the fifth lever 85 to the starting position. Therefore, there is a fear that the carriage returning operation is hindered by the engagement between the rack body 32 and the CA.H cam 28, as a result of the rotation of the CR.BS shaft 34 through the fifth lever 85 before the resetting of the carriage 7 to the home position.

In consequence, the carriage returning operation is repeated until the resetting of the carriage 7 to the home position is detected. Meanwhile, the printer does not make any new printing operation. Also, for effecting the back spacing of the carriage 7, the WS shaft 26 selects the visible position while the CS shaft 20 takes the back spacing position, i.e. the selection of the type character corresponding to the second cam groove 59*b* of the third CS shaft cam 59 of the CS shaft 20. In consequence, as in the case of the carriage returning operation, the rotation of the CC shaft 62 is transmitted as the output $0_2$ from the cam-lever group 105 to the gear 84 of the CR.BS shaft 34. However, this output $0_2$ acts to rotate the CR.BS shaft only by a small rotation angle, so that the rack body 32 of the CR.BS shaft 34 is rotated by an amount necessary for the back spacing by ½ pitch, thereby to effect the back spacing.

The selective power transmission between the motor and shafts will be understood from the foregoing description. Hereinunder, a description will be made as to each operation, as well as the detailed construction of the associated parts.

CONSTRUCTION AROUND TYPE CARRIER AND OPERATION FOR SELECTING ROTATIONAL POSITION OF TYPE WHEEL

The four type wheel 13 of the type carrier 14 have equal shape and size. In the illustrated embodiment, each type wheel carries 24 type characters. Thus, the type carrier 14 as a whole carries 96 type characters including letters of upper and lower case, numerals, symbols and so forth.

Figure 5:
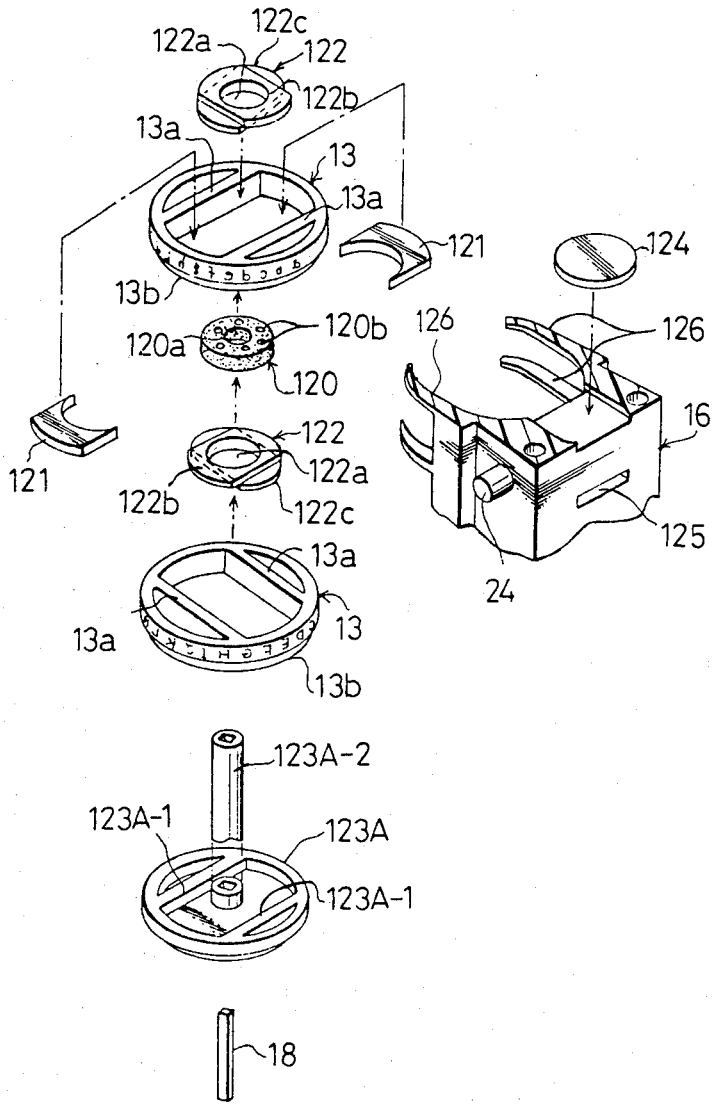
FIG. 5 is an exploded perspective view of a type wheel group and a mechanism for holding the latter in a serial printer in accordance with the invention.
Figure 6:
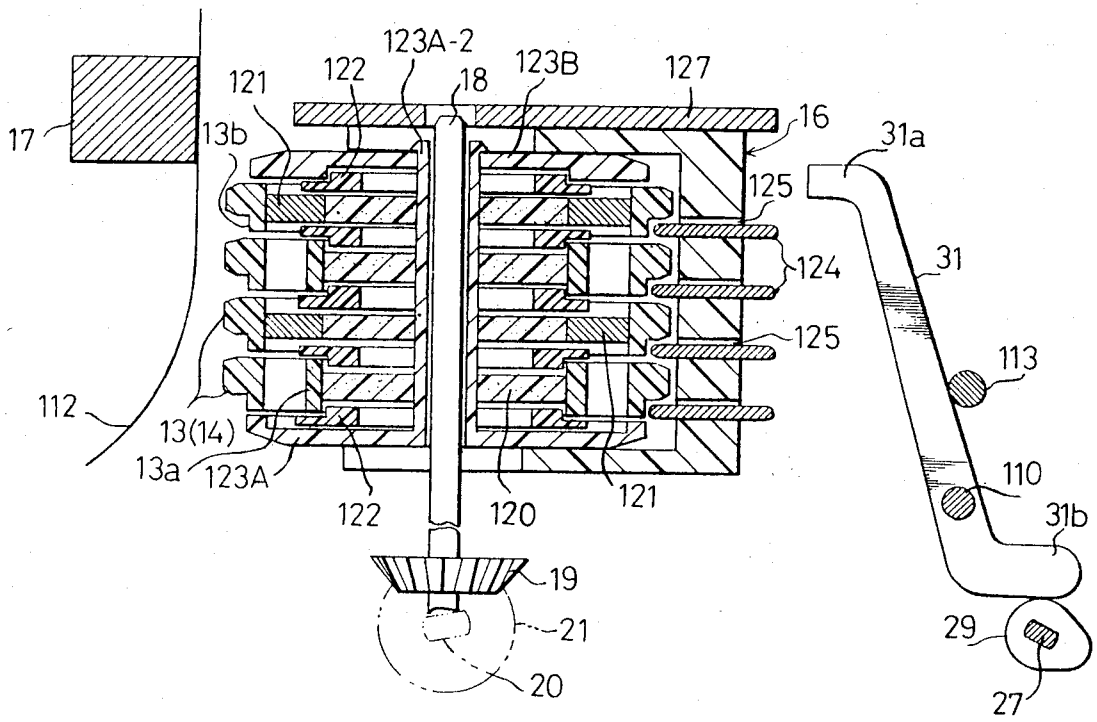
FIG. 6 is a sectional view showing the interior of the carriage of a serial printer of the invention, showing particularly a type wheel force-out mechanism in the non-printing condition, with a part thereof being omitted.
Figure 7:
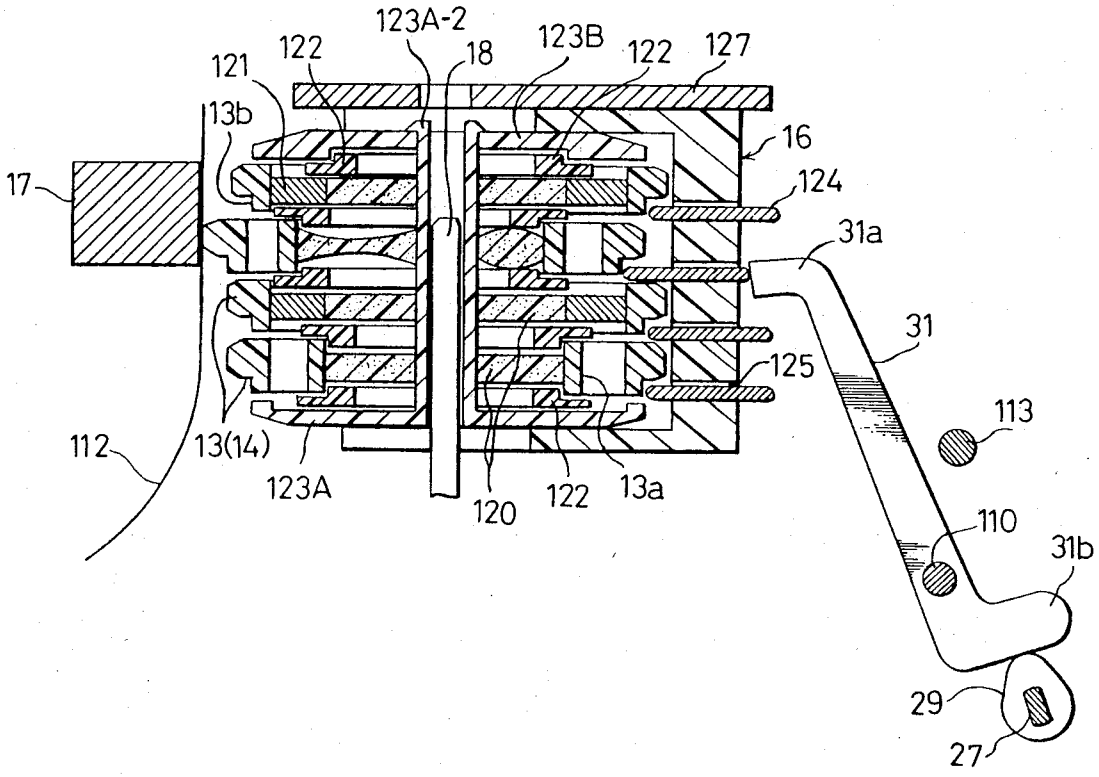
FIG. 7 is a sectional view showing the interior of the carriage of a serial printer of the invention, showing particularly a type wheel force-out mechanism in the printing condition, with a part thereof being omitted.

As will be understood from FIGS. 5,6 and 7, each type wheel 13 has an annular form and is provided at the inside thereof with a pair of parallel partition walls 13*a*,13*a*. Disposed at the center of an oval chamber defined by these partition walls 13*a*,13*a*, is an elastic ring 120 made of an elastic rubber of a plastic, and is located by a filler 121. Reference numeral 122 denotes slide rotors provided at the upper and lower sides of each type wheel and disposed between the partition walls 13*a*,13*a* in such a manner so as to be able to slide only along the partition walls 13*a*,13*a*. Each slide rotor 122 has an upper part 122*b* and a lower part 122*c* having straight portions intersecting at a right angle. The arrangement is such that the upper part 122*b* of a slide rotor 122 belonging to one type wheel 13 engages the lower part 22*c* of the slide rotor 122 belonging to the overlying type wheel 13, while the lower part 122*c* of the slide rotor 122 engages with the upper part 122*b* of the slide rotor belonging to the underlying type wheel 13. Thus, the type wheels 13 are connected in layers through the medium of the slide rotors 122 with their partition walls 13*a* intersecting at a right angle, to form a so-called Oldham's joint.

A reference numeral 123 denotes a bobbin splined to the type wheel shaft 18 and constituted by a lower bobbin part 123A and an upper bobbin part 123B. The upper bobbin part 123B makes a snap fit in the end of hollow shaft portion 123A-2 of the lower bobbin part 123A. The hollow shaft portion 123A-2 extends through the central bore 120*a* of each elastic ring 120 and the central bore 122*a* of the slide rotor 122. The lower bobbin part and the upper bobbin part 123A,123B are provided with partition walls (only the partition wall 123A-1 of the lower bobbin part 123-A is shown). The partition walls of the lower and upper bobbin parts 123A,123B are engaged by the slide rotor 122 of the type wheel of the lowermost stage and the slide rotor 122 of the upper part of the uppermost type wheel 13, respectively. Thus, an Oldham's joint is formed also between the bobbin 123 and the type wheel 13. In consequence, the torque of the type wheel 18 is transmitted to each type wheel 13 through the bobbin 123. Thus, each type wheel 13 is adapted to rotate as a unit with the type wheel shaft 18 and, by a resilient deformation of the elastic ring 120, each type wheel 13 is movable in the direction perpendicular to the axis of the type wheel shaft 18. In order to facilitate the movement of the type wheel in the direction perpendicular to the shaft 18, each elastic ring 120 is provided with a plurality of small apertures 120*b*, as will be understood from FIG. 5.

To force the type wheel outwardly towards the platen 18 at a right angle to the axis of the shaft 18, each type wheel 13 is supported at its step 13*b* by means of the support arms 126,126 of the holder 16, so that the type wheel is guided only in the directions toward and away from the platen 17 by the support arms 126,126. The holder 16 has groove windows 125 accomodating respective disc-shaped pressing plates 124. The pressing plates are partially exposed through the associated groove windows 125 so as to oppose the steps 13*b* of the type wheels 13.

Therefore, as the hammer 31 is rotated to press the pressing plate 124 as illustrated in FIG. 7, the pressing plate 124 presses the step 13*b* of the type wheel 13 to cause a resilient deformation of the elastic ring 124 thereby to press the type wheel 13 against the platen 17 through the medium of the printing paper 112. As the hammer 31 is returned to the initial position, the type wheel 13 pressed toward the platen 17 is returned to the starting position by the resilient force of the elastic ring 120. In FIGS. 5,6 and 7, a reference numeral 127 designates a top cover in support of the aforementioned ink roller 15, suitably attached to the holder 16.

As described before, the selection of rotational position of the type wheel 13 is conducted by rotating the type carrier 14 by the power of the motor through the second clutch 55, CS shaft 20, bevel gears 21,19, typw wheel shaft; 8, bobbin 13 and the Oldham's joint and then stopping the type carrier 14 by turning the second clutch 55 off by the action of the GS lever 56 through energization of the CS solenoid 101. The construction and operation concerning the selection of rotational position of the type wheel 13 have been described in detail already so that, at this moment, the detailed description is omitted.

Attention must be drawn here to the fact that, since the operation for selecting the rotational position of the type wheel functions as the trigger for various operations such as the spacing of the carriage 7 in the forward direction, carriage returning, back spacing, paper feeding and so forth, even when the vertical shift of the type wheel 14 is not made nor necessary, the selection of rotational position of the type wheel is made at each time of the above-mentioned operation. Also, as stated before, the reference position signal is obtained at each time of the selection of the rotational position, so that the type carrier 14 necessarily makes more than one rotation before the selection of the type character, so that the entire periphery of the type carrier 14 is applied with the ink by the ink roller 15 at each time of the type selecting operation.

SHIFT POSITION SELECTING OPERATION OF THE TYPE CARRIER

Figure 8:
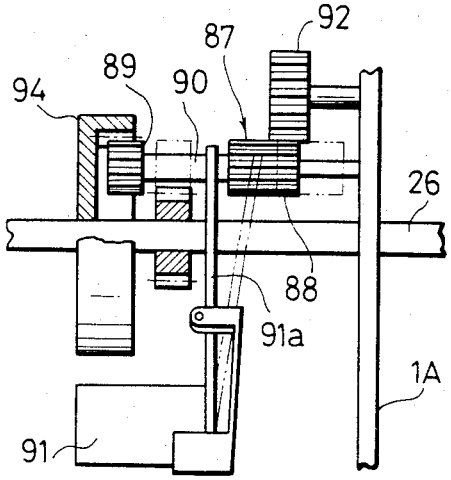
FIG. 8 is a plan view of a mechanism (switching clutch effecting a switching between upward and downward movement of the type wheel group in a serial printer of the invention.

As stated already, when the switching of the shifting direction (direction of rotation of the WS shaft 26) is necessitated, the vertical shifting of the type carrier 14 is made in advance to the rotation of the WS shaft 26. Namely, as will be seen from FIG. 8, the switching gear body 87 for transmitting the torque of the motor 2 to the WS shaft 26 in forward or backward direction takes the position shown by full line in FIG. 8 when the switching solenoid 91 is energized to engage with the internally toothed gear 94 of the WS shaft 26. To the contrary, when the switching solenoid 91 is not energized, the switching gear body 87 takes the position shown by two-dots-and-dash line in FIG. 8 to make engagement with the gear 93 of the WS shaft 26.

When the switching gear body 87 meshes with the internally toothed gear 94, as the WS solenoid 104 shown in FIG. 2 is energized, the torque of the motor 2 is transmitted to the WS shaft 26 through the third clutch 66 thereby to rotate the WS shaft 26 counter-clockwise as viewed in FIG. 2.

In consequence, the shift cams 25,25, which are splined to the WS shaft 26 to move as a unit with the carriage 7, are rotated in the counter-clockwise direction as viewed in FIG. 3. In consequence, the shift levers 23,23, whose projections (not shown) being engaged by the spiral cam grooves **25*a*,25*a* of the shift cams 25,25, are rotated clockwise as viewed in FIG. 3 around the support shaft 22. In consequence, the holder 16, which has a projection 24 engaging the bifurcated end of the shift lever 23, is shifted up and down together with the type carrier 14. In FIG. 3, reference numeral 128,128 denotes support shafts for guiding the vertical movement of the carrier 16 and fixed to the bottom plate 11 of the carriage 7**.

When the switching gear body 87 meshes with the gear 93, the WS shaft 26 and the shift cam 25 are rotated in the reverse direction to that described above, so that the shift lever 23 is rotated in the counter-clockwise direction as viewed in FIG. 3, thereby to shift the holder 16 (type carrier 14) downwardly.

When the type wheel 14 takes the desired shift position, the WS solenoid 104 is de-energized so that the third clutch 66 is turned off to stop the WS shaft 26 to stop the type carrier 14 and hold it at the desired shift position, as stated before. FIG. 6 shows the state in which the type carrier 14 selects the visible position, while FIG. 7 shows the state in which the type wheel of the second stage from the top has been shifted to the printing position.

ACTUATION OF HAMMER AND SPACING OF CARRIAGE

After the completion of the selection of the rotational position and shift position of the type wheel 14, the CS lever 56 and the WS lever 69 are disengaged from the cam groove **70*a* of the first CC shaft cam 70, while the fourth clutch 71 is turned on to permit the CC shaft 62 to be driven by the motor 2**.

The selection of the rotational position and the selection of the shift position are achieved simultaneously. It does not matter whether the CS lever 56 or the WS lever 69 first comes out of the cam groove **70*a* of the first CC shaft cam 70. However, if the detection of the rotational position is finished first to permit the first CC shaft cam 70 to be stationed, the CS lever 56 is reset by the spring as the CS solenoid 101 is de-energized, so that the CS lever 56 comes into engagement with the cam groove 70*a*. The selection of the shift position is finished then, so that the CS lever 56 prevents the first CC cam 70 from rotating even if the WS lever 69 is disengaged from the cam groove 70*a*. In consequence, the fourth clutch 71 can never be turned on. In order to avoid such a situation, a countermeasure illustrated in FIG. 9** is taken.

Figure 9:
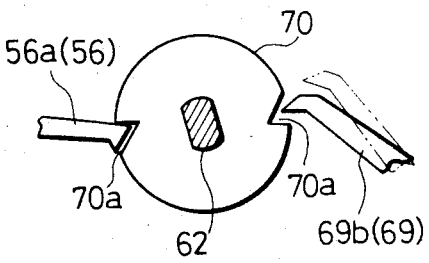
FIGS. 9*a* and 9*b* are simplified side elevational views of a serial printer in accordance with the invention, showing particularly the operations of a first CC shaft cam, CS lever and WS lever.
Figure 9:
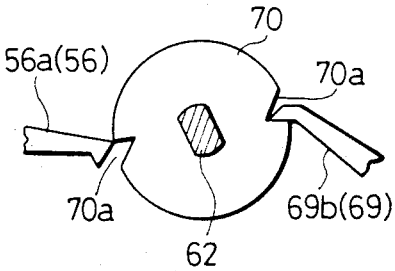

FIG. **9*a* shows the state in which both of the CS shaft 20 and the WS shaft 26 are rotating. More specifically, the CS solenoid 101 is not energized to permit the CS lever 56 to abut the vertical surface of the cam groove 70*a* of the first CC shaft cam 70. At the same time, the WS solenoid 104 is energized to bring the WS lever 69 from the position shown by two-dots-and-dash line to the position shown by full line, while the end of the WS lever 69 is positioned within the cam groove 70*a*. The WS lever 69 which is moved into the cam groove 70*a* when actuated by the energized solenoid 104 comes into the portion of the cam groove which is about 5° to 10° advanced in the direction of rotation of the first CC shaft cam 70 (counter-clockwise direction) and is kept out of contact with the vertical surface of the cam groove 70*a*. Therefore, when the CS solenoid 101 is kept energized over a predetermined period and as the CS lever 56 comes out of the cam groove 70*a* in advance to the WS lever 69, i.e. as the lever 56 rotates in the clockwise direction, the first CC shaft cam 70 is allowed to make a rotation of a small angle in the counter-clockwise direction as viewed in FIG. 9. The first CC shaft cam 70 is stopped after the WS lever 69 is rotated into contact with the vertical wall of the cam groove 70*a*. Meanwhile, the fourth clutch 71 is kept on for a while. When the first CC shaft cam 71 takes the slightly rotated position, the CS lever 56 tends to be rotated counter-clockwise by the spring force as a result of the de-energization of the CS solenoid 101, but the CS lever 56 does not come into the cam groove 70***a* but abuts the circular outer peripheral surface of the first CC shaft cam 70 as shown in FIG. 9*b*.

In consequence, the CS lever 56 is maintained, resisting to the force of the spring, in such a state that the lever portion 56*a* is kept in contact with the circular outer periphery of the first CC shaft cam 70, while the other lever portion 56*b* engages the teeth of the ratchet 54. Thereafter, as the WS lever 69 is disengaged from the cam groove 70*a* as a result of the de-energization of the WS solenoid 104 (stopping at the selected shift position), the first CC shaft cam 70 is allowed to rotate as a result of the turning on of the fourth clutch 71 to cause about a half rotation of the CC shaft 62 until the CS lever 56 drops into the cam groove 70*a* by the spring force. Thus, the CC shaft 62 rotates by an angle which is 180° minus 5° to 10°. Needless to say, while the CC shaft 62 makes a small angle rotation of 5° to 10°, the third lever 82, PF lever 50 and the fourth lever 103 engaging, respectively, with the cam projections 72*b*,73*a* and 74*a* of the second, third and fourth CC shaft cams 72,73 and 74 do not drop into the associated cam grooves 72*a*,73*b* and 74*b* but are maintained in contact with the cam projections 72*b*,73*a* and 74*a*.

As the CC shaft 62 starts to rotate, the second CC shaft cam 72 starts to rotate accompanied by a movement of the cam groove 72*a* to a position engageable with the third lever 82. Then, as stated before, the third lever 82 drops into the cam groove 72*a* of the second CC shaft cam 72 only when the first lever 102 takes a position opposing to the small-diameter portion 57*b* of the first CS shaft cam 57 or the cam groove 57*c* of the same, thereby to turn the fifth clutch 78 on to permit the CA.H shaft 27 to make one full rotation.

Figure 10:
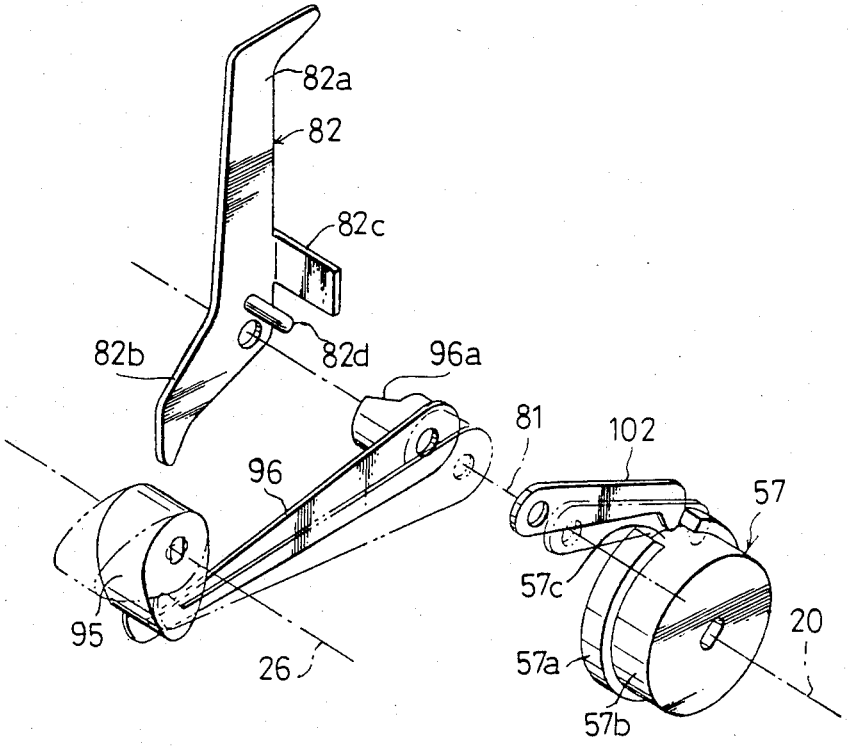
FIG. 10 is an exploded perspective view of a cam-lever mechanism which operates at the time of selection of the visible position of the type wheel group.

FIG. 10 shows an example of the end surface cam formed between the second lever 96 and the third lever 82.

Referring to FIG. 10, the first and second levers 102,96 are brought into close contact with the third lever 82 by the force of springs. When the WS shaft 26 takes the visible position, the second level 96 is depressed by the projection of the first WS shaft cam 95, as shown by full line. In this case, a pin 82*d* of the third lever 82 contacts the lower plane of the end surface cam 96*a* of the second lever 96, so that the first lever biased by the spring takes a position opposing the large diameter portion 57*a* of the first CS shaft 57. When the CS shaft takes a position other than the visible position, the end of the first lever 102 is in contact with the outer periphery of the large-diameter portion 57*a*, and prevents the third lever 82 from engaging the cam groove 72*a* of the second CC shaft cam 72.

Also, when the WS shaft 26 takes a position other than the visible position, the second lever 96 is lifted by the spring force as shown by two-dots-and-dash line in FIG. 10. In consequence, the pin 82*d* of the third lever 82 is moved to the higher plane of the end surface cam 96*a* along the tapered surface of the latter. As a result, the first lever 102 is pushed by the second lever 96 to move to the right as viewed in FIG. 10, so that the end of the first lever 102 opposes the small-diameter portion 57*b* of the first CS shaft cam 57 with a small gap therebetween. When the first lever 102 takes this position shown by two-dots-and-dash line in FIG. 10, the third lever 82 is allowed to move irrespective of the rotational position of the CS shaft 20, so that it comes into engagement with the cam groove 72*a* of the second CC shaft cam 72. Therefore, the fourth clutch 71 controlled by the third lever 82 is turned in to cause a one full rotation of the CA.H shaft 27.

The one full rotation of the CA.H shaft 27 causes one full rotation of the CA.H cam 28 (See FIG. 3) splind to the CA.H shaft 27 and movable together with the carriage 7.

Figure 11:
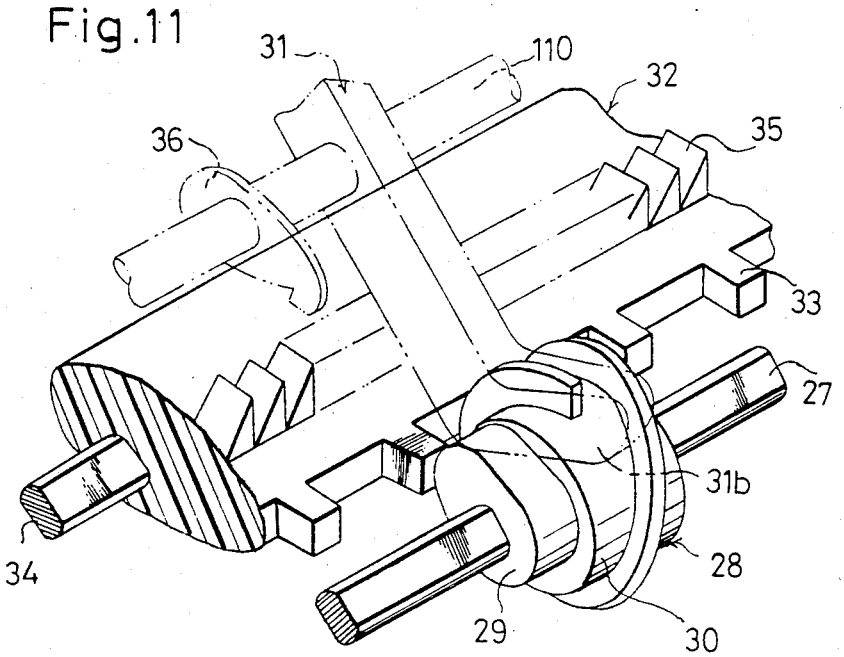
FIG. 11 is a partly simplified perspective view showing a carriage carrying mechanism and a hammer actuating mechanism in a serial printer in accordance with the invention.

As will be seen from FIG. 11, the CA.H cam has a hammer cam 29 and a screw cam 30 integral with each other. The hammer cam 29 is contacted at its periphery by the bend 31*b* of the hammer 31.

The hammer 31 is mounted by the support shaft fixed to the carriage 7, in such a manner as to be able to rotate on the support shaft 110 but can never move axially. The hammer 31 is biased by a spring in the clockwise direction as viewed in FIGS. 6,7 and 11, and is held in contact with the stopper 113 (See FIGS. 6 and 7) when printing is not made. In the earlier half part of the rotation of the CA.H shaft 27 in the clockwise direction in FIGS. 6,7 and 11, the projection of the hammer cam 29 acts to rotate the hammer 31 counter-clockwise as shown in FIG. 7, so that the striker 31*a* of the hammer 31 forces the selected type wheel 13 through the action of the pressing plate 124 toward the platen 17 to effect the printing of the desired character on the paper 112.

The printing operation is thus made simply by forcing out the type wheel 13 made of a comparatively soft synthetic rubber and then pressing the type wheel applied with ink over its entire circumference lightly on the paper 112, so that the impact of the type wheel 13 on the platen 17 is made in quite a gentle manner to reduce the printing noise.

Figure 12:
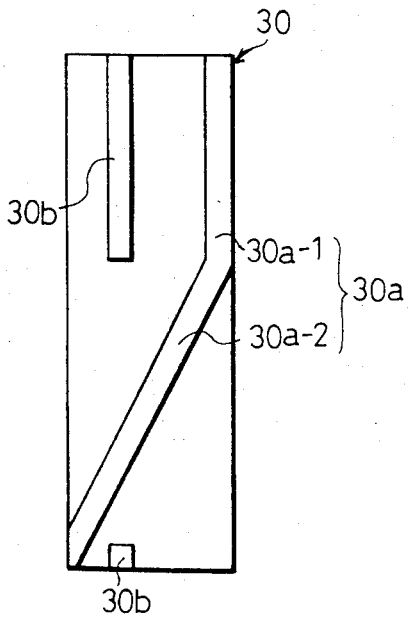
FIG. 12 is an exploded view of a screw cam incorporated in a serial printer in accordance with the invention.

As will be understood from the developed view in FIG. 12, a first tooth portion 30*a* and a second tooth portion 30*b* are formed on the outer periphery of the screw cam 30. The first tooth portion 30*a* has a circumferential straight section 30*a*-1 intersecting the CA.H shaft 27 and an inclined section 30*a*-2. Each section 30*a*-1, 30*a*-2 occupies almost a half of one rotation of the screw cam 30. On the other hand, the second tooth portion 30*b* is formed in parallel with the straight section 30*a*-1 of the first tooth portion 30*a* and to occupy the same region as the straight section 30*a*-1 in the direction of rotation.

Figure 14:
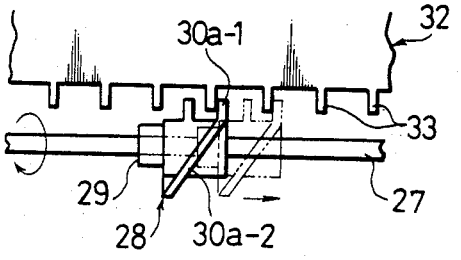
FIG. 14 is a simplified plan view of the carriage shifting mechanism in a serial printer in accordance with the invention.

Usually, the first tooth portion 30*a* is in engagement with the rack teeth 33 of the rack body 32, except the case immediately after the back spacing by $n+\frac{1}{2}$ pitch. In the earlier half part of the CA.H shaft, i.e. the CA.H cam 28, the straight section 30*a*-1 engages with the rack teeth 33, while, in the later half part of the rotation of the same, the rack teeth 33 is engaged by the inclined portion 30*a*-2. Therefore, in the eariler half part of rotation of the CA.H shaft 27, the Ca.H cam, i.e. the carriage 7, does not move along the rack body 32, while, in the later-half part of rotation of the CA.H shaft 27, the CA.H cam 28 (carriage 7) is shifted by one pitch (pitch of rack teeth 33) along the rack body 32. FIG. 14 shows the state of shifting of the CA.H cam 28. It will be seen that the CA.H cam 28 is moved from the full line position to the position shown by two-dots-and-dash line by one full rotation of the CH.H shaft 27.

Figure 13:
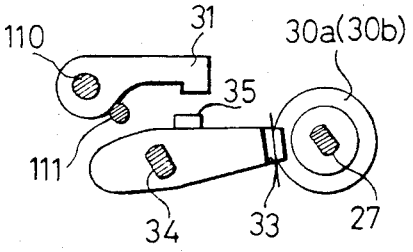
FIG. 13 is a simplified side elevational view of a carriage shifting mechanism in a serial printer in accordance with the invention.

Referring to FIGS. 11 and 13, a reference numeral 36 denotes a claw carried by the support shaft 110 fixed to the carriage 7. The claw 36 is allowed only to rotate on the support shaft 110. This claw is always biased clockwise by a spring not shown. In the normal state, the claw is kept in contact with the stopper 111, and the end of the claw 36 is positioned to oppose to the saw-tooth-like projection 35 of the rack body 32 with a predetermined gap therebetween.

CARRIAGE SPACING WITHOUT PRINTING

The spacing of the carriage 7 in the forward direction (direction away from the home position) is achieved by making the type carrier 14 select the visible position shown in FIG. 6, making the CS shaft 20 select the spacing position and then effecting one full rotation of the CA.H shaft 27. Namely, the hammer 31 makes an idling operation in the earlier half part of the rotation of the CA.H shaft 27 and, in the later half part of the rotation of the same, the CA.H cam 28 (carriage 7) is shifted by one pitch.

The detailed description has been made already in this connection, so that no further detailed description seems necessary. It is, however, to be noted here that the rotary selection of the WS shaft 26 is not performed in the continuous spacing operation, but the CS shaft 20 solely is rotated to the spacing position at each shifting, pitch by pitch. This applies also to the case where the shift position of the shift position of the type carrier 14 is beforehand known from the continuous typing instruction, and the rotational position selection of the CS shaft 20 is effected solely when the type characters in the same type wheel are used for the printing continuously. For shifting the carriage 7 by ½ pitch in the forward direction, the later-mentioned ½ pitch back spacing is conducted subsequently to a shifting of the carriage 7 by one pitch in the forward direction.

CARRIAGE RETURN

For resetting the carriage 7 at the home position, as stated before, the WS shaft 26 selects the home position while the CS shaft 20 selects the carriage return position, so that only rotational the fourth and fifth levers 103,105 on the lever shaft 81 is allowed, wherein the fifth lever 85 engages the first cam groove 59*a* of the third CS shaft cam 59 to largely rotate the CR.BS shaft 34.

Figure 15A:
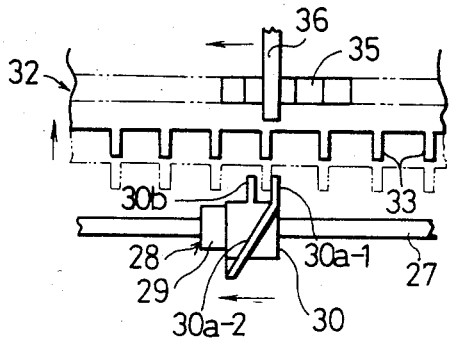
FIGS. 15A and 15B are a simplified plan view and a simplified side elevational view of the carriage returning mechanism in returning condition.
Figure 15B:
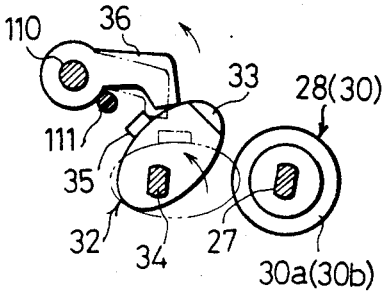

Then, as the CR.BS shaft makes a large rotation, the rack body 32 having rack teeth 33 engaging the screw cam 30 of the CA.H cam 28 is rotated in the direction of the arrow in FIG. 15*b*, and is moved from the position shown by two-dots-and-dash line to the full-line position.

In consequence, the claw 36 is rotated by the rack member 32 and contacts the flat portion of the rack body 32. Therefore, the rack body 32 is placed out of engagement with the CA.H cam carried by the carriage 7 and the claw 36, so that the carriage 7 is released rapidly to the home position by the resetting force of the coiled spring 10.

In the state shiwn in FIG. 15*b*, since the rack 32 has a large rotation torque and since a large friction is preserved between the CA.H shaft and the bearing, the rack body 32 cannot be depressed by the claw 36 which is urged by a spring of quite a light force. This return operation is continued until the resetting of the carriage 7 to the home position is confirmed.

BACKSPACING OF CARRIAGE

For effecting the back spacing of the carriage 7, as stated before, the WS shaft 26 is made to select the home positioned while the CS shaft 20 is made to select the back spacing position, so that the fifth lever 85 engages with the second cam groove 59*b* of the third CS shaft cam 59 thereby to effect a small rotation of the CR.BS shaft 34.

Figure 16A:
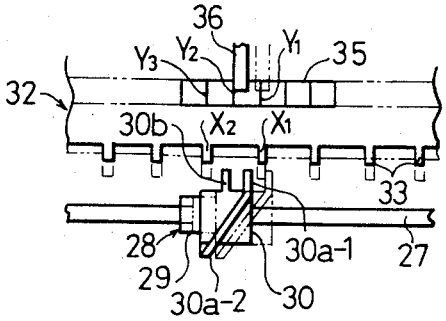
FIGS. 16A to 19B are illustrations of the back spacing operation, in which each Figure having suffix "A" is a simplified plan view of the back spacing mechanism while each Figure having suffix "B" is a simplified side elevational view corresponding to Figure "A".

Before the CR.BS shaft 34 starts to rotate, the CA.H cam 28 (screw cam 30) which has been shifted by forward spacing and then stopped takes the position shown by two-dots-and-dash line in FIG. 16*a* in which the first tooth portion 30*a* and the straight section 30*a*-1 are in contact with the rack teeth 33. Namely, since the carriage 7, i.e. the CA.H cam 28 is pulled to the left as viewed in the drawing by the force of the coiled spring 10, the straight section 30*a*-1 is kept in close contact with the rack tooth 33. Representing the teeth portion contacted by the straight section 30*a*-1 by $X_1$, the aforementioned claw 36 is positioned to oppose the projection $Y_1$ of the saw-tooth like projection 35 at a distance from the latter.

As the CR.BS shaft makes a small rotation from the position shown by two-dots-and-dash line, the rack body 32 is moved to the position shown by full line in FIG. 16*a*. In consequence, the CA.H cam 28 is released from the rack teeth 33, and the carriage 7 starts to move toward the home position by the force of the coiled spring 10, together with the CA.H cam 28 and the claw 36.

Figure 16B:
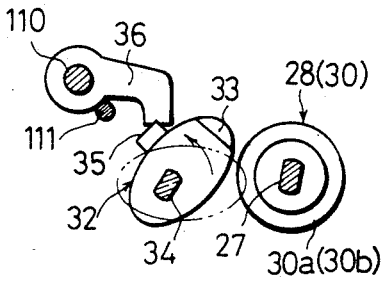

However, since the rack body 32 takes a rotational position shown in FIG. 16*b*, the claw 36 makes a contact with the projection $Y_2$ next to the saw-tooth-like projection $Y_1$, so that the carriage 7 is moved slightly and prevented from being reset. (See full line in FIG. 16) Immediately after this operation, the fourth CC shaft cam 74 which has driven the fourth and fifth levers 103 and 85 stops after resetting the fourth lever 103. At the same time, as a result of the stopping of the CC shaft 62, the CS shaft 20 starts to rotate to reset the fifth lever 85. In consequence, the CR.BS shaft 34 is reset together with the fifth lever 85 so that the rack teeth 33 of the rack body 32 are moved to the position for engagement with the screw cam 28.

Figure 17A:
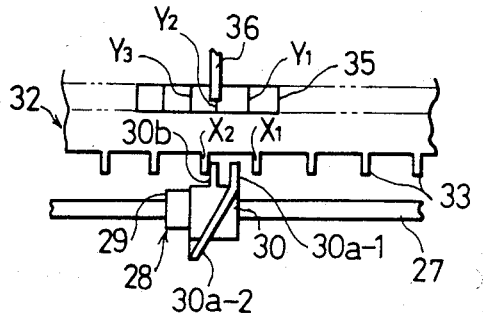
Figure 17B:
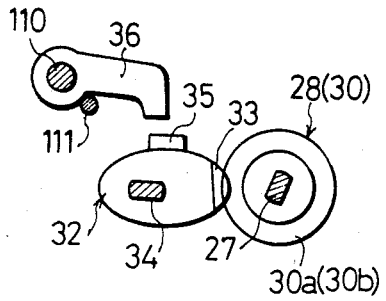

As a result of the resetting of the rack body 32, the engagement between the projection $Y_2$ of the rack body 32 and the claw 36 is dismissed, and the CA.H cam 28 is slightly spaced back by the tensile force of the coiled spring 10, until the second teeth portion 30*b* of the screw cam 30 comes into contact with the teeth portion $X_2$ adjacent to the teeth portion $X_1$ of the rack teeth 33, to take the position illustrated in FIG. 17*a*.

As a result of this series of operations, the CA.H cam 28 is moved from the position of two-dots-and-dash line in FIG. 16*a* to the position in FIG. 17*a* by a back spacing. Thus, the carriage 7 is spaced back by a ½ pitch.

As the CA.H shaft 27 makes one rotation from the position shown in FIG. 17*a*, a half part of the inclined section 30*a*-2 of the first tooth 30*a* of the screw cam 30 meshes with the rack teeth 33, so that the CA.H cam 28, i.e. the carriage 7, is spaced in the forward direction by a half pitch.

Figure 18A:
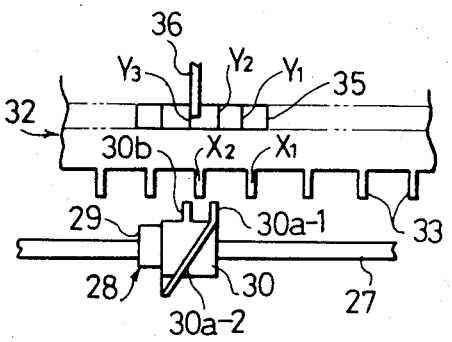
Figure 18B:
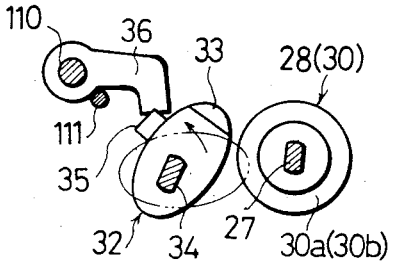
Figure 19A:
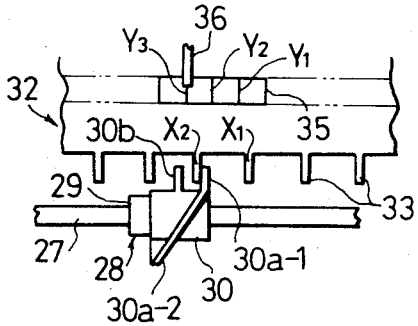
Figure 19B:
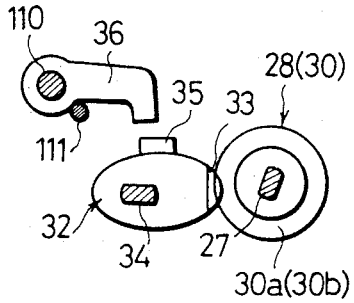

As the above-described back spacing operation is made from the position shown in FIG. 17*a*, the rack member 32 is rotated in the same manner as the operation explained before, so that the CA.H cam 28 is moved to the position shown in FIG. 19 via a state in which the claw 36 makes contact with the third projection next to the projection $Y_2$ of the saw-tooth-like projection $Y_2$ as shown in FIG. 18. In the state shown in FIG. 19, the straight section 30*a*-1 of the first tooth portion 30*a* of the screw cam 30 contacts the tooth portion $X_2$ of the rack teeth 33. Thus, the carriage 7 is back spaced by one pitch from the position shown by two-dots-and-dash line in FIG. 16. As the CA.H shaft 27 makes one rotation from the position shown in FIG. 19*a*, the CA.H cam is spaced by one pitch in the forward direction to resume the position shown by two-dots-and-dash line in FIG. 16*a*.

The above-explained operation is repeated if it is desired to further space the carriage back from the position shown in FIG. 19*a*.

As has been described, according to the invention, it is possible to use a single motor as the power source for rotation and vertical shifting of the type carrier, and as the power source of the hammering action, as well as power sources of various other kinds of operation, to eliminate the number of large-sized and expensive motors, thereby to make it possible to produce less-expensive light-weight and small-sized serial printers suitable for use in portable electric typewriters.

What is claimed is:

1. A serial printer comprising:

(a) a carriage adapted to be shifted from a starting position along a line to be printed;

(b) a print head mounted on said carriage;

(c) a rack having first and second engagement portions angularly spaced from each other and extending over the shifting region of said carriage;

(d) a reset spring biasing said carriage toward the starting position;

(e) means including a body rotatably mounted on said carriage and having a spiralling tooth portion extending outwardly and adapted to engage said first engagement portion of said rack;

(f) a rotatable shaft splined to said body and extending over the shifting region of said carriage and transmitting rotation to said body to shift said body and carriage along said rack for forward motion by overcoming the force of said reset spring;

(g) rack rotating means for controlling the state of engagement between said rack and said tooth portion of said body and for rotating said rack from said state of engagement to either a carriage return rotative position or a back spacing rotative position; and (h) engaging means mounted on said carriage for engaging said second engagement portion of said rack to prevent said carriage from being returned to said starting position during the back spacing of said carriage towards said starting position by a predetermined distance by said reset spring when said rack takes said back spacing rotative position, wherein when said rack takes said carriage return rotative position, said engaging means does not engage with said rack thereby permitting said carriage to be returned to said starting position by the force of said reset spring.

2. A serial printer as claimed in claim 1, further comprising:

(a) said print head comprising a type cylinder;

(b) shifting means for shifting said type cylinder up and down;

(c) type cylinder rotating means for rotating said type cylinder;

(d) means for rotating said rack rotating means to said carriage return position with said type cylinder located in a specific shift position and a first specific rotational position; and (e) means for rotating said rack rotating means to said back spacing position with said type cylinder located in a specific shift position and a second specific rotational position.

3. A serial printer as claimed in claim 2, wherein said specific shift position of said type clyinder is a position enabling characters previously printed to be visible to the operator.

* * * * *